US009070987B2

(12) United States Patent
Knowlden et al.

(10) Patent No.: US 9,070,987 B2
(45) Date of Patent: Jun. 30, 2015

(54) CONNECTOR WITH SECURE WAFER RETENTION

(71) Applicant: Samtec, Inc., New Albany, IN (US)

(72) Inventors: Donald Christopher Knowlden, Harrisburg, PA (US); Randall Eugene Musser, Enola, PA (US); John Allen Mongold, Middletown, PA (US); Chadrick Paul Faith, Corydon, IN (US)

(73) Assignee: Samtec, Inc., New Albany, IN (US)

( * ) Notice: Subject to any disclaimer, the term of this patent is extended or adjusted under 35 U.S.C. 154(b) by 59 days.

(21) Appl. No.: 14/067,047

(22) Filed: Oct. 30, 2013

(65) Prior Publication Data

US 2015/0118913 A1 Apr. 30, 2015

(51) Int. Cl.
*H01R 9/16* (2006.01)

(52) U.S. Cl.
CPC ..... *H01R 9/16* (2013.01)

(58) Field of Classification Search
USPC ..... 439/660, 701, 79, 74, 108, 607.05, 439/607.07, 607.39
See application file for complete search history.

(56) References Cited

U.S. PATENT DOCUMENTS

| | | | | | |
|---|---|---|---|---|---|
| 4,676,579 | A * | 6/1987 | Ting | 439/825 |
| 5,073,119 | A * | 12/1991 | Soes | 439/82 |
| 5,115,375 | A * | 5/1992 | Garay | 361/760 |
| 5,715,595 | A * | 2/1998 | Kman et al. | 29/845 |
| 6,352,436 | B1 * | 3/2002 | Howard | 439/82 |
| 6,475,042 | B1 * | 11/2002 | Yu | 439/857 |
| 6,593,535 | B2 * | 7/2003 | Gailus | 174/262 |
| 7,628,645 | B2 * | 12/2009 | Baba et al. | 439/567 |
| 7,665,207 | B2 * | 2/2010 | Fraley et al. | 29/834 |
| 7,862,347 | B2 * | 1/2011 | Amleshi et al. | 439/82 |
| 7,927,109 | B1 * | 4/2011 | Gattuso | 439/66 |
| 7,963,776 | B1 * | 6/2011 | Morgan | 439/75 |
| 2004/0108137 | A1 * | 6/2004 | Vetter et al. | 174/262 |
| 2006/0180346 | A1 * | 8/2006 | Knight et al. | 174/265 |
| 2010/0085717 | A1 * | 4/2010 | Sweeney et al. | 361/761 |

* cited by examiner

*Primary Examiner* — Alexander Gilman
(74) *Attorney, Agent, or Firm* — Keating & Bennett, LLP

(57) ABSTRACT

A connector includes a connector body, a plurality of wafers arranged within the connector body, and a weld tab defined by a unitary member that includes a plurality of weld tab legs and a plurality of weld tab arms. The plurality of weld tab arms are arranged to engage with corresponding weld tab arm holes included in the connector body, and the plurality of weld tab legs are arranged to engage with a circuit board when the connector is mounted to the circuit board. The weld tab prevents the plurality of wafers from withdrawing from the connector body when the plurality of weld tab arms are engaged with the corresponding weld tab arm holes.

35 Claims, 31 Drawing Sheets

CONNECTOR WITH SECURE WAFER RETENTION

BACKGROUND OF THE INVENTION

1. Field of the Invention

The present invention relates to connectors. More specifically, the present invention relates to connectors that include wafers.

2. Description of the Related Art

Connectors are used to place electrical devices in communication with one another, and right-angle connectors are often used to connect an electrical device or cable to a circuit board. An example of a right-angle connector 101 that is mounted to a circuit board 120 using weld tabs 130 is shown in FIGS. 1-3. As shown in FIG. 1, the right-angle connector 101 includes wafers 110 with wafer legs 112 that are electrically connected to pads 121 of the circuit board 120. Interior ones of the wafers 110 are not shown in FIG. 1 for clarity. The right-angle connector 101 is aligned to the circuit board 120 by alignment pins 103 that are molded into the body 102 of the right-angle connector 101 and alignment holes 122 of the circuit board 120. As shown in the cross-sectional view of FIG. 2, the weld tabs 130 pass through tab holes 104 of the right-angle connector 101 to engage with weld holes 123 of the circuit board 120 to secure the right-angle connector 101 to the circuit board 120 and to reduce stresses applied to solder joints between the wafer legs 112 and the pads 121 of the circuit board 120. These solder joints are provided by solder 119 that is attached to the wafer legs 112 and then reflowed after the right-angle connector 101 is mounted to the circuit board 120 to provide electrical connections between the wafer legs 112 and the pads 121. FIG. 3 shows the wafer legs 112 and the weld tabs 130 respectively engaged with the pads 121 and the weld holes 123, with the connector body 102 removed for clarity.

However, in right-angle connector 101, the weld tabs 130 do not provide alignment for the wafers 110 and do not retain the wafers 110 within the right-angle connector body 102. Further, since the weld tabs 130 are separate elements that individually secure the right-angle connector 101 to the circuit board 120, large manufacturing tolerances are required for the right angle connector 101, the wafers 110, and the circuit board 120 due to a high probability of alignment inaccuracies between the right-angle connector 101 and circuit board 120.

Furthermore, due to the geometrical structure of the right-angle connector 101, the connector body 102 has a tendency to twist along its longitudinal or lengthwise axis, for example, when exposed to high temperatures during soldering of the wafer legs 112 to the pads 121 of the circuit board 120. As shown in FIGS. 1 and 3, adjacent ones of the wafers 110 do not interlock with each other and thus do not resist the twisting of the connector body 102. Accordingly, any twisting of the connector body 102 may affect the alignment of the wafer legs 112, for example, by causing the bottom surfaces of the wafer legs 112 to not be co-planar which results in poor electrical connections between the wafer legs 112 and the pads 121 of the circuit board 120. Furthermore, poor electrical connections between the wafer legs 112 and the pads 121 of the circuit board 120 may also arise from the bottom surfaces of the solder 119 not being co-planar, for example, due to the above-described twisting of the connector body 102 or the solder 119 being unevenly applied to neighboring wafer legs 112.

When the right-angle connector 101 is mounted to the circuit board 120, the optimal location for each of the wafer legs 112 is centered above its corresponding pad 121. However, since the solder 119 is attached to the sides of the wafer legs 112, the solder 119 is offset from the center of their corresponding pads 121. Accordingly, the pads 121 have oblong (e.g., ovaloid) shapes so that the wafer legs are centered and the solder 119 is able to contact their corresponding pads 121 without bleeding solder onto neighboring pads 121 when the solder 119 is reflowed.

SUMMARY OF THE INVENTION

To overcome the problems described above, preferred embodiments of the present invention provide a right-angle connector with a weld tab that accurately aligns the right-angle connector during mounting and secures wafers within the right-angle connector.

A connector according to a preferred embodiment of the present invention includes a connector body, a plurality of wafers arranged within the connector body, and a weld tab defined by a unitary member that includes a plurality of weld tab legs and a plurality of weld tab arms. The plurality of weld tab arms are arranged to engage with corresponding weld tab arm holes included in the connector body, and the plurality of weld tab legs are arranged to engage with a circuit board when the connector is mounted to the circuit board. The weld tab prevents the plurality of wafers from withdrawing from the connector body when the plurality of weld tab arms are engaged with the corresponding weld tab arm holes.

Preferably, a first group of the plurality of wafers each includes a wafer lug, the weld tab includes a plurality of weld tab slots arranged to receive the wafer lugs, the first group of the plurality of wafers that each includes the wafer lug are arranged in an alternating manner in the connector body with respect to a second group of the plurality of wafers that do not each include the wafer lug, and the plurality of weld tab slots are arranged to engage with the wafer lugs when the plurality of weld tab arms are engaged with the corresponding weld tab arm holes.

Each of the plurality of wafers preferably includes at least one wafer leg arranged to engage the circuit board when the connector is mounted to the circuit board. Preferably, the at least one wafer leg of each of the plurality of wafers includes a fusible member arranged at a lower portion thereof, and the fusible member of the at least one wafer leg is arranged so that a contact area between the fusible member and the corresponding pad on the circuit board overlaps with a centerline of the at least one wafer leg. The corresponding pad on the circuit board is preferably circular or substantially circular.

Each of the plurality of wafers preferably includes at least one wafer leg arranged to engage with a corresponding pad on the circuit board when the connector is mounted to the circuit board, and each of the plurality of wafers preferably includes at least one wafer arm arranged to engage with a corresponding wafer arm hole included in the connector body. Each of the at least one wafer leg and each of the at least one wafer arm are preferably provided in a corresponding pair defined by a single, unitary member. The at least one wafer arm preferably passes through the connector body and is exposed at a contact section of the connector.

Preferably, one planar surface of each of the plurality of wafers includes a wafer rib, and another planar surface of each of the plurality of wafers includes a wafer groove. Preferably, the wafer rib of at least one of the plurality of wafers is received by the wafer groove of at least another one of the plurality of wafers. The connector body preferably includes a connector rib, and the wafer groove of one of the plurality of wafers preferably receives the connector rib. The connector body preferably includes a connector groove, and the connector groove preferably receives the wafer rib of one of the plurality of wafers.

At least one of the plurality of wafers preferably includes a vertical rib that engages with a corresponding vertical slot included in the connector body.

Preferably, one of the plurality of weld tab legs has a width greater than remaining ones of the plurality of weld tab legs to align the connector with respect to the circuit board.

The plurality of weld tab legs are preferably arranged to engage with corresponding weld holes in the circuit board when the connector is mounted to the circuit board. Preferably, one of the weld holes in the circuit board is narrower than remaining ones of the weld holes to align the connector with respect to the circuit board. Preferably, the plurality of weld tab legs is arranged to mechanically deform when inserted into the corresponding weld hole of the circuit board to frictionally fit and align the connector to the circuit board. The plurality of weld tab legs preferably, when the connector is mounted to the circuit board, are arranged to be inserted into the corresponding weld holes and soldered to the corresponding weld holes when the connector is mounted to the circuit board, are arranged to be surface mounted to the circuit board, or are arranged as a clip to mechanically secure the connector to the circuit board.

The above and other features, elements, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will now be described in detail with reference to FIGS. 4A to 25. Note that the following description is in all aspects illustrative and not restrictive, and should not be construed to restrict the applications or uses of the present invention in any manner.

Figure 1:
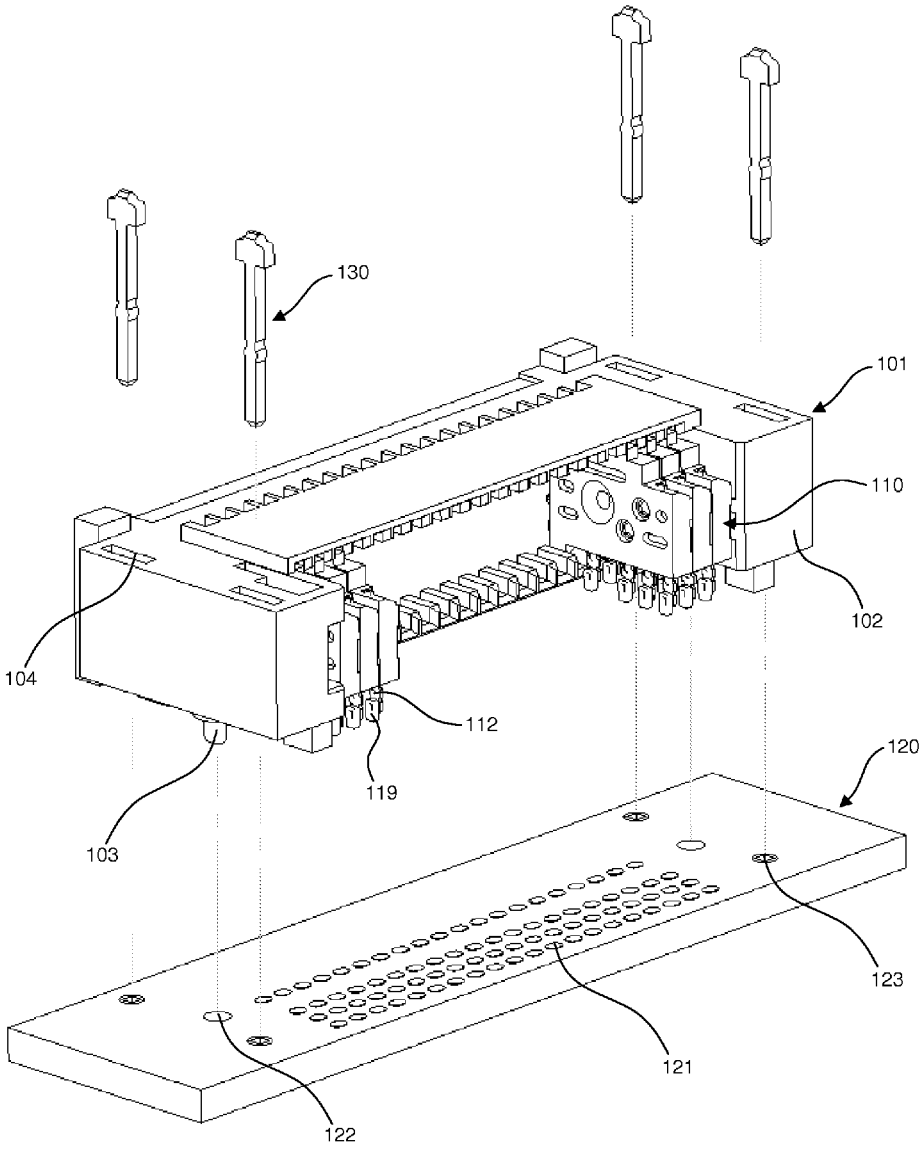
FIG. 1 PRIOR ART
FIG. 1 is a perspective view of a right-angle connector mounted to a circuit board using weld tabs according to the related art.
Figure 2:
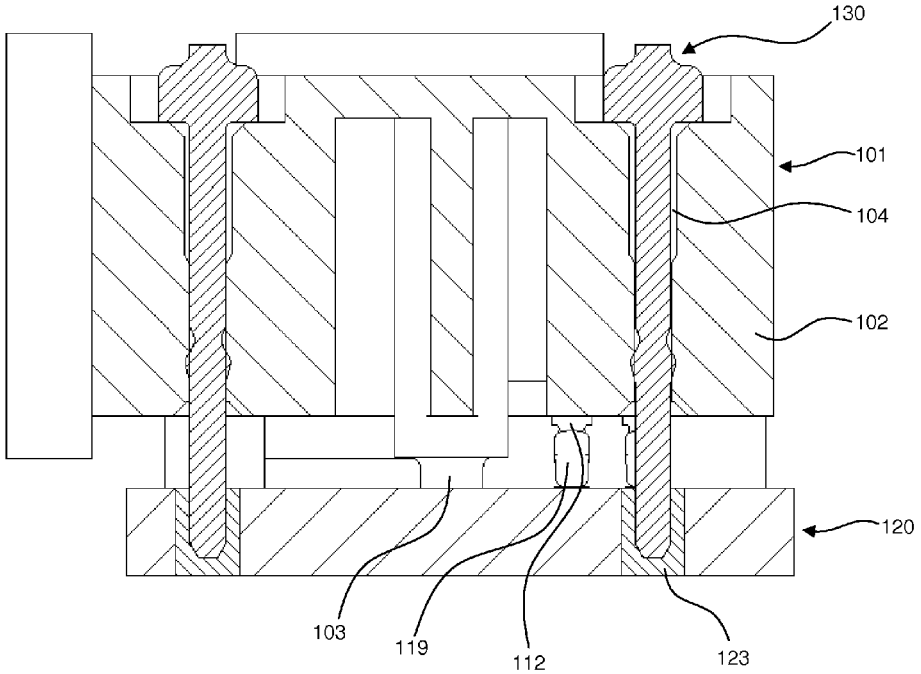
FIG. 2 PRIOR ART
FIG. 2 is a cross-sectional view of the right-angle connector, the weld tabs, and the circuit board of FIG. 1.
Figure 3:
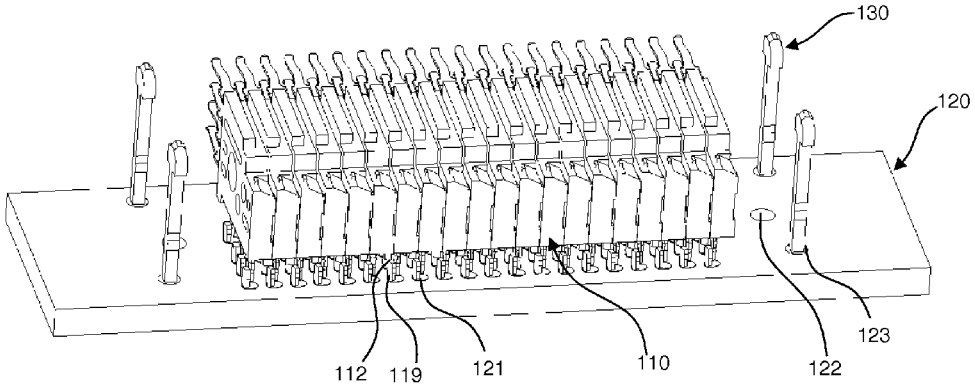
FIG. 3 PRIOR ART
FIG. 3 is a perspective view of the right-angle connector, the weld tabs, and the circuit board of FIG. 1 with the connector body removed for clarity.
Figure 4A:
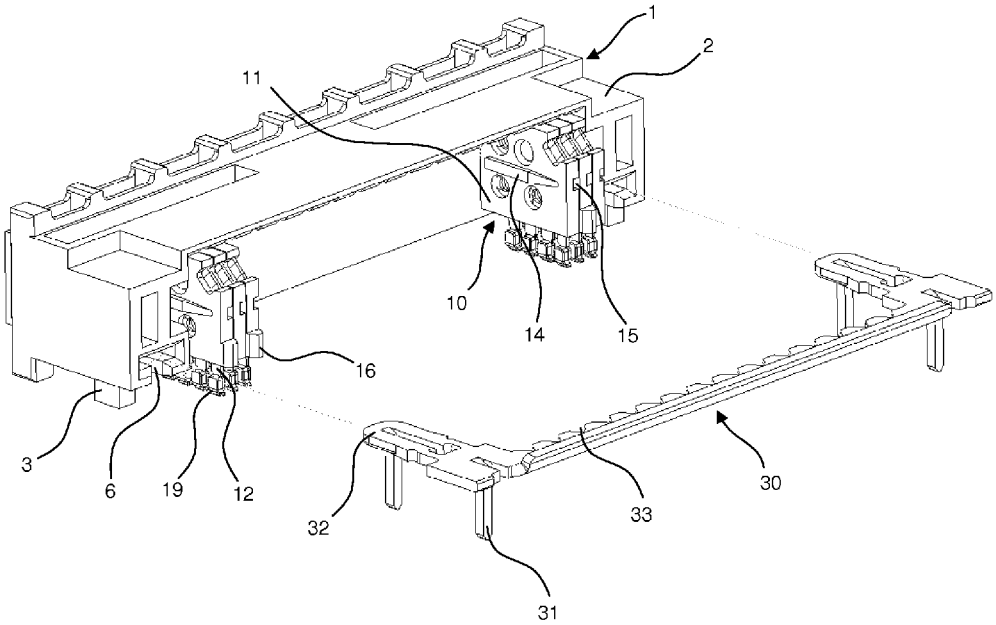
FIGS. 4A and 4B are front and rear perspective views of a right-angle connector and a wafer-holding weld tab according to a preferred embodiment of the present invention.
Figure 4B:
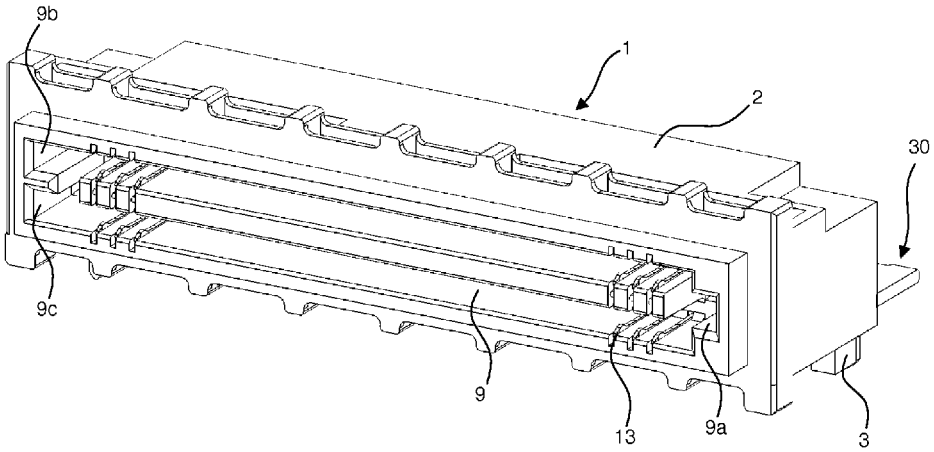
Figure 5:
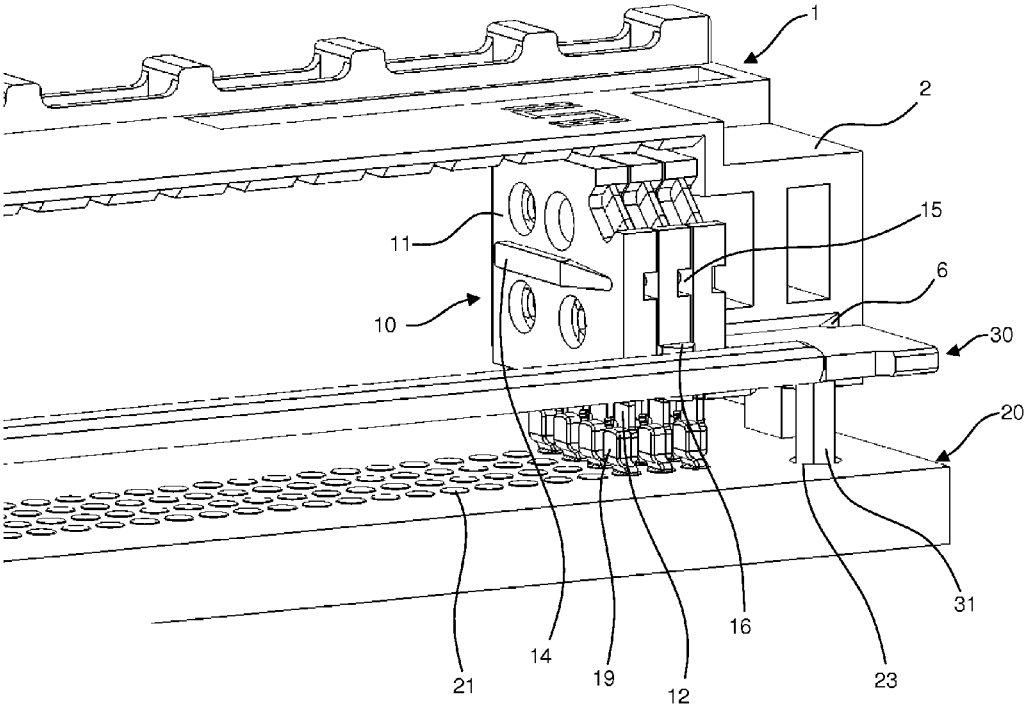
FIG. 5 is a perspective view of the right-angle connector and the wafer-holding weld tab shown in FIGS. 4A and 4B connected to a circuit board.

FIGS. 4A to 14 show a right-angle connector 1 and a wafer-holding weld tab 30 in accordance with a preferred embodiment of the present invention. Although reference number 30 is commonly referred to as a "weld" tab, wafer-holding weld tab 30 is not typically welded. As explained below, the wafer-holding weld tab 30 is typically soldered to a circuit board but can also be press-fit or mechanically attached to a circuit board. FIGS. 4A and 4B are perspective views of a right-angle connector 1 that includes wafers 10 and a wafer-holding weld tab 30 according to a preferred embodiment of the present invention. FIG. 5 is a perspective view of the right-angle connector 1 and the wafer-holding weld tab 30 connected to a circuit board 20. Interior ones of the wafers 10 are not shown in some of the drawings for clarity.

Figure 7:
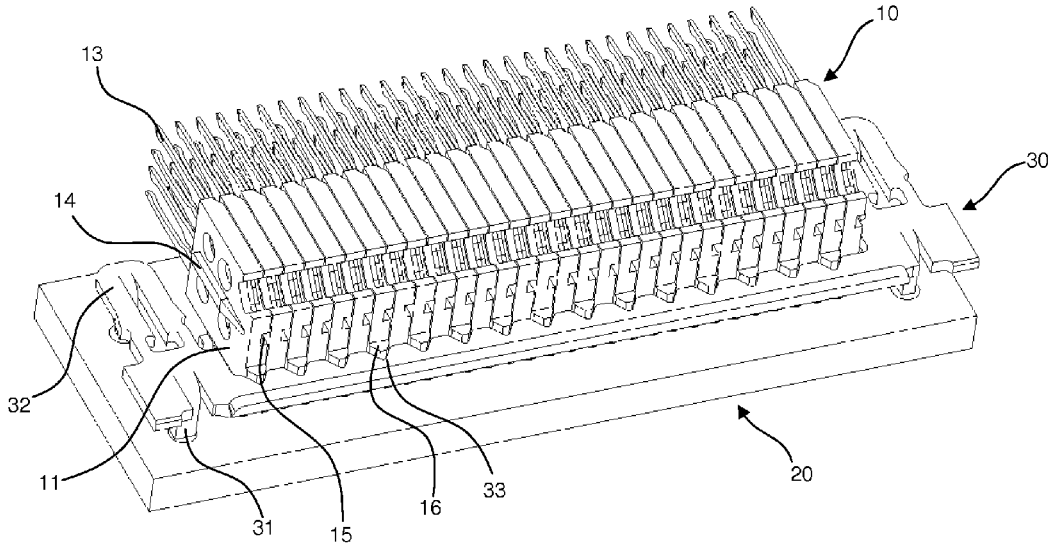
FIG. 7 is a perspective view of the right-angle connector, the wafer-holding weld tab, and the circuit board of FIGS. 4A, 4B, and 5 with the connector body removed for clarity.

As shown in FIGS. 4A and 5, the right-angle connector 1 includes wafers 10 with wafer legs 12 that are electrically connected to pads 21 of the circuit board 20. The right-angle connector 1 is arranged on the circuit board 20 by standoffs 3 that are molded into the body 2 of the right-angle connector 1 to ensure proper spacing between the right-angle connector 1 and the circuit board 20. The wafer-holding weld tab 30 includes weld tab arms 32 that engage with weld tab arm holes 6 of the right-angle connector 1 and weld tab legs 31 that engage with weld holes 23 of the circuit board 20 to secure the right-angle connector 1 to the circuit board 20 and to reduce stresses applied to solder joints between the wafer legs 12 and the pads 21 of the circuit board 20. These solder joints are preferably provided by solder charges 19 that are attached to the wafer legs 12 and then reflowed after the right-angle connector 1 is mounted to the circuit board 20 to provide electrical connections between the wafer legs 12 and the pads 21. Instead of solder charges 19, any fusible member that can mechanically secure the wafer legs 12 to the circuit board 20 while providing an electrical connection, including, for example, crimped solder, solder balls, etc., can be used. FIG. 7 shows the wafer-holding weld tab 30 engaged with the wafers 10 and the weld holes 23, with the connector body 2 removed for clarity.

Figure 6:
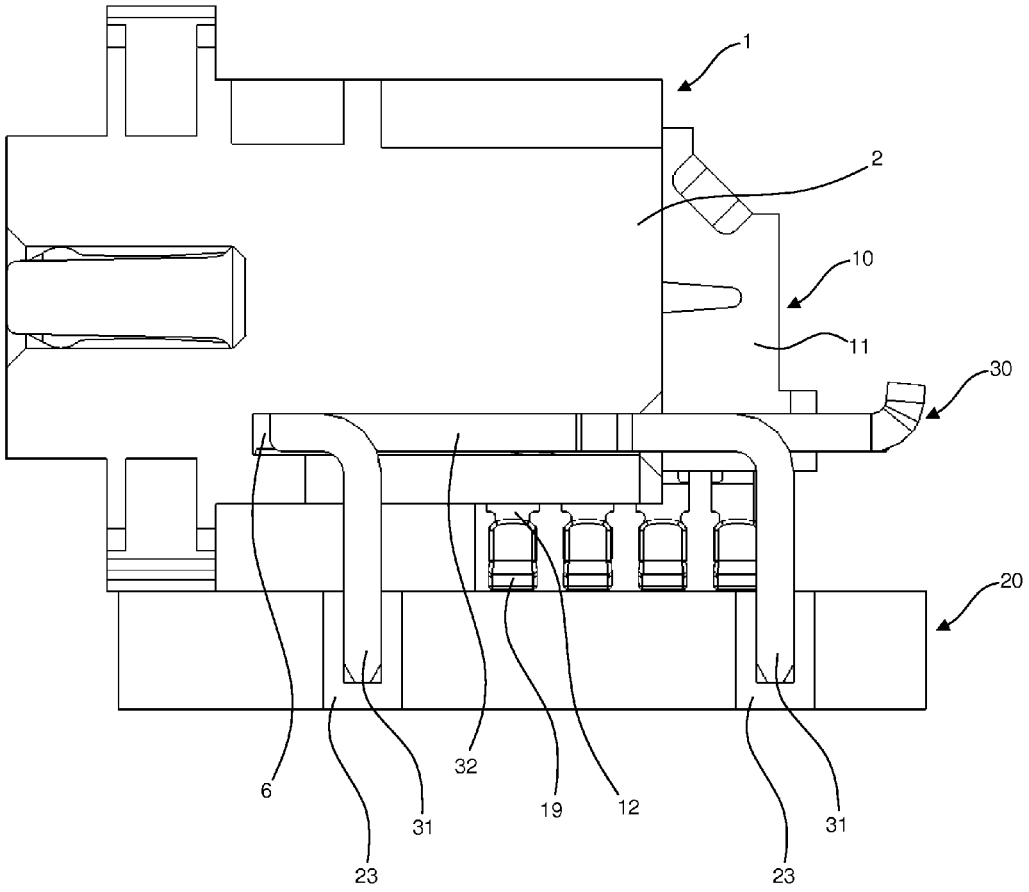
FIG. 6 is a cross-sectional view of the right-angle connector, the wafer-holding weld tab, and the circuit board shown in FIGS. 4A, 4B, and 5.
Figure 8A:
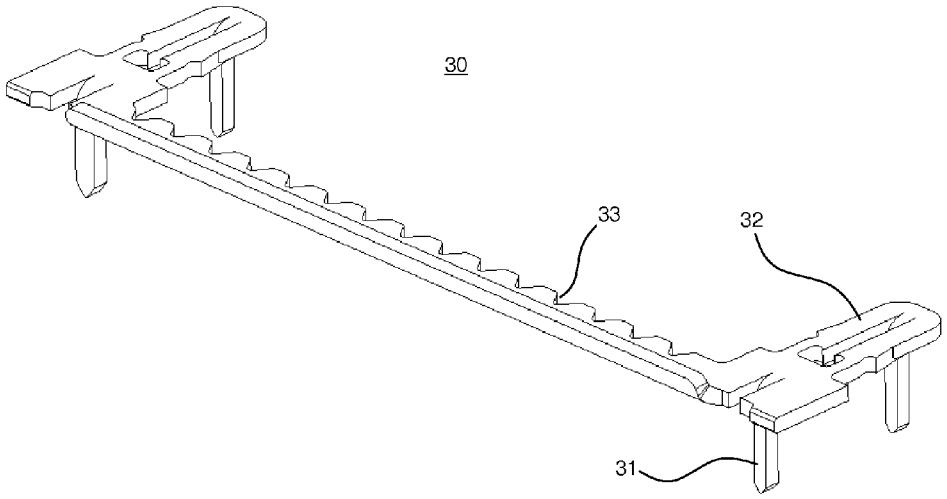
FIGS. 8A and 8B are perspective and top views of the wafer-holding weld tab shown in FIGS. 4A and 4B.
Figure 8B:
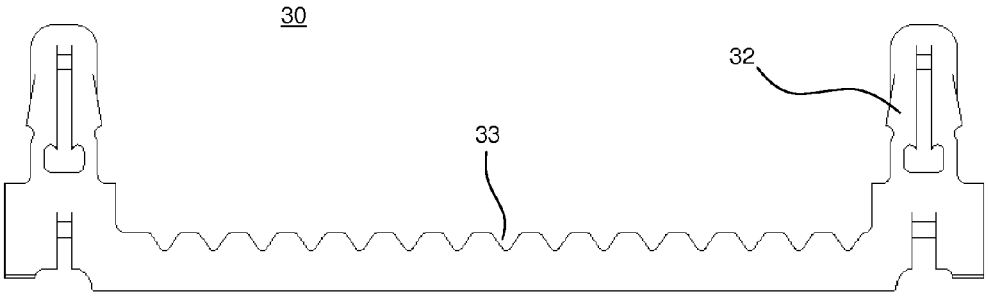

As shown in FIGS. 4A, 6, and 8A, the wafer-holding weld tab 30 preferably includes four weld tab legs 31 that engage with corresponding weld holes 23 in the circuit board 20. FIG. 6 is a cross-sectional view showing two of the weld tab legs 31 inserted into two corresponding weld holes 23. The weld holes 23 are preferably lined with a fusible material, for example solder, so as to provide plated through holes. Accordingly, the solder included in the weld holes 23 may be reflowed after the weld tab legs 31 are inserted therein to secure the right-angle connector 1 to the circuit board 20.

As shown in FIGS. 4A and 7 to 9B, the wafer-holding weld tab 30 preferably includes a weld tab slots 33 that engage with wafer lugs 16 that are integrally molded on alternating ones of the wafers 10. Accordingly, when the weld tab arms 32 of the wafer-holding weld tab 30 are fully inserted into the weld tab arm holes 6 of the right-angle connector 1, the wafer lugs 16 interlock with the weld tab slots 33 to ensure that the wafer legs 12 of the wafers 10 align with the correct corresponding pads 21 of the circuit board 20. The wafer-holding weld tab 30 also prevents the wafers 10 from accidentally withdrawing from the right-angle connector 1. Furthermore, the wafer-holding weld tab 30 provides a rigid structure that resists any shifting of the wafers 10 or twisting of the connector body 2 along its longitudinal or lengthwise axis, for example, when the right-angle connector 1 is exposed to high temperatures during soldering of the wafer legs 12 to the pads 21 of the circuit board 20.

As shown in FIG. 4B, a side of the right-angle connector 1 opposite to the location of the wafer-holding weld tab 30 includes a contact section 9 for mating with an electrical device or another connector. The wafer arms 13 are exposed in the contact section 9 when the wafers 10 are inserted into the connector body 2. Accordingly, the electrical device or the another connector is able to be inserted into the contact section 9 of the right-angle connector 1 in a direction that is parallel or approximately parallel to the top planar surface of the circuit board 20. Preferably, the contact section 9 includes polarization notches 9*a*, 9*b*, and 9*c* to ensure that the electrical device or the another connector is inserted into the contact section 9 in the proper orientation.

Figure 9A:
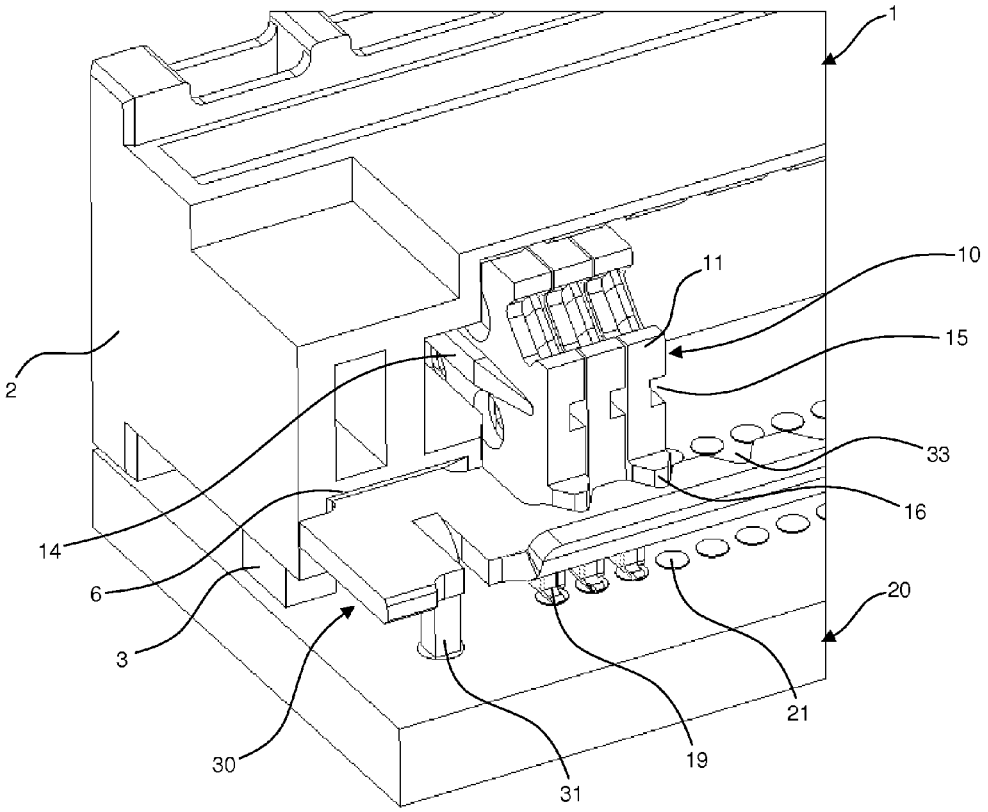
FIG. 9A is a perspective view of the right-angle connector, the wafer-holding weld tab, and the circuit board shown in FIGS. 4A, 4B, and 5.
Figure 9B:
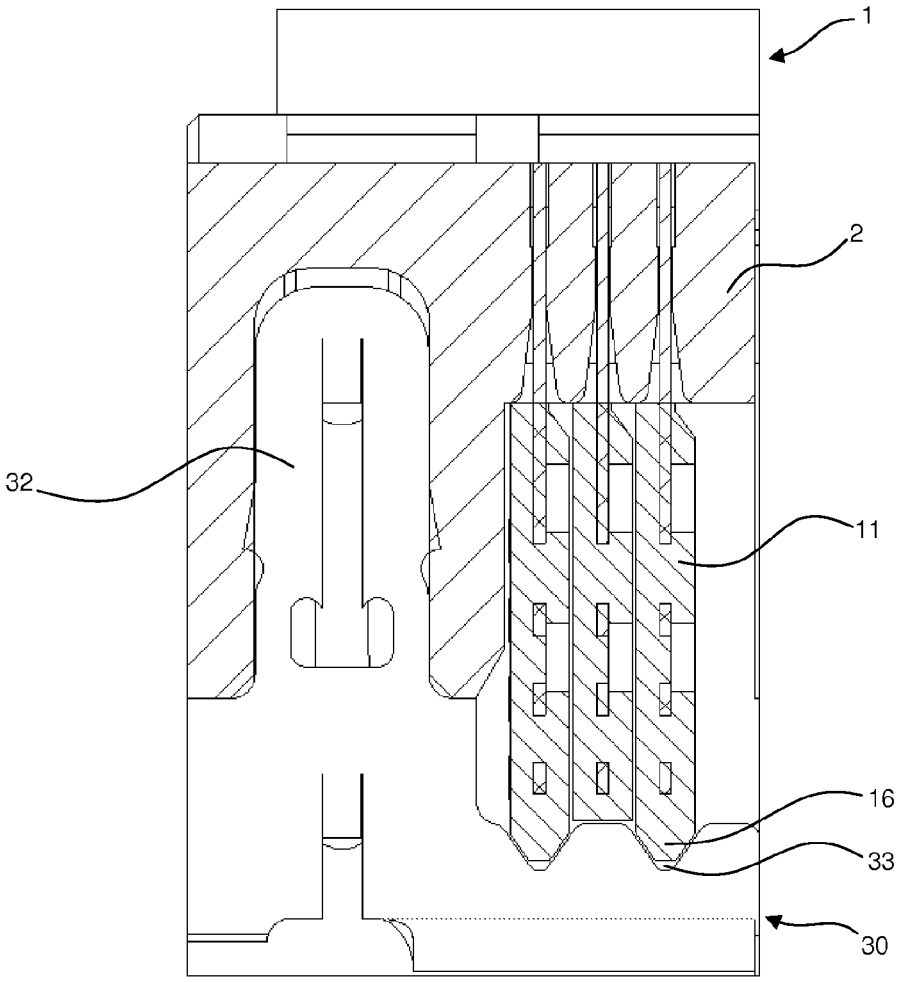
FIG. 9B is a cross-sectional view of the right-angle connector and the wafer-holding weld tab shown in FIGS. 4A and 4B.
Figure 10:
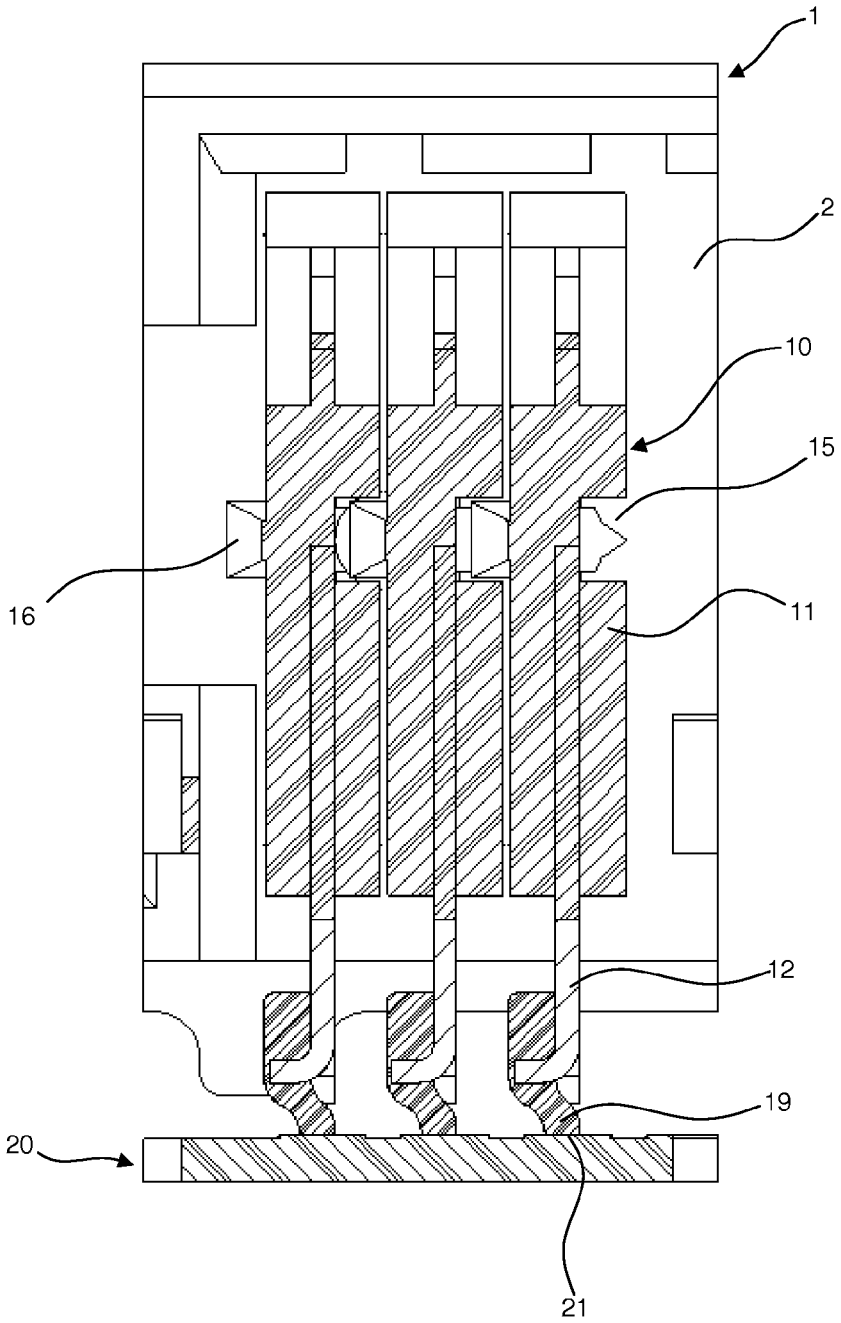
FIG. 10 is a cross-sectional view of the right-angle connector and the circuit board shown in FIGS. 4A, 4B, and 5.

As shown in FIGS. 5, 9A, and 10 a lower portion of each of the solder charges 19 is preferably tapered and angled such that the contact area between the solder charges 19 and their corresponding pads 21 of the circuit board 20 overlap with the centerline of their corresponding wafer legs 12. Accordingly, due to the shape of the lower portion of the solder charges 19, both the solder charges 19 and the wafer legs 12 can be centered over their corresponding pads 21. Thus, the pads 21 can be formed in circular shapes (i.e., not oblong shapes) because the solder charges 19 are not offset from the centers of the pads 21, which allows for secure electrical connection even if there are slight misalignments between the wafer legs 12 and the pads 21. More specifically, centering the contact area between the solder charges 19 and their corresponding pads 21 provides a greater tolerance for the solder charges 19 to only reflow solder to their corresponding pad 21 and not a neighboring one of the pads 21, thus preventing unwanted electrical connections among pads 21. Moreover, the solder charges 19 may have the tapered and angled shape shown in FIGS. 5, 9A, and 10 before being attached to the wafer legs 12 having, or the solder charges 19 may have the tapered and angled shape after being crimped or deposited on the wafer legs 12.

Figure 11A:
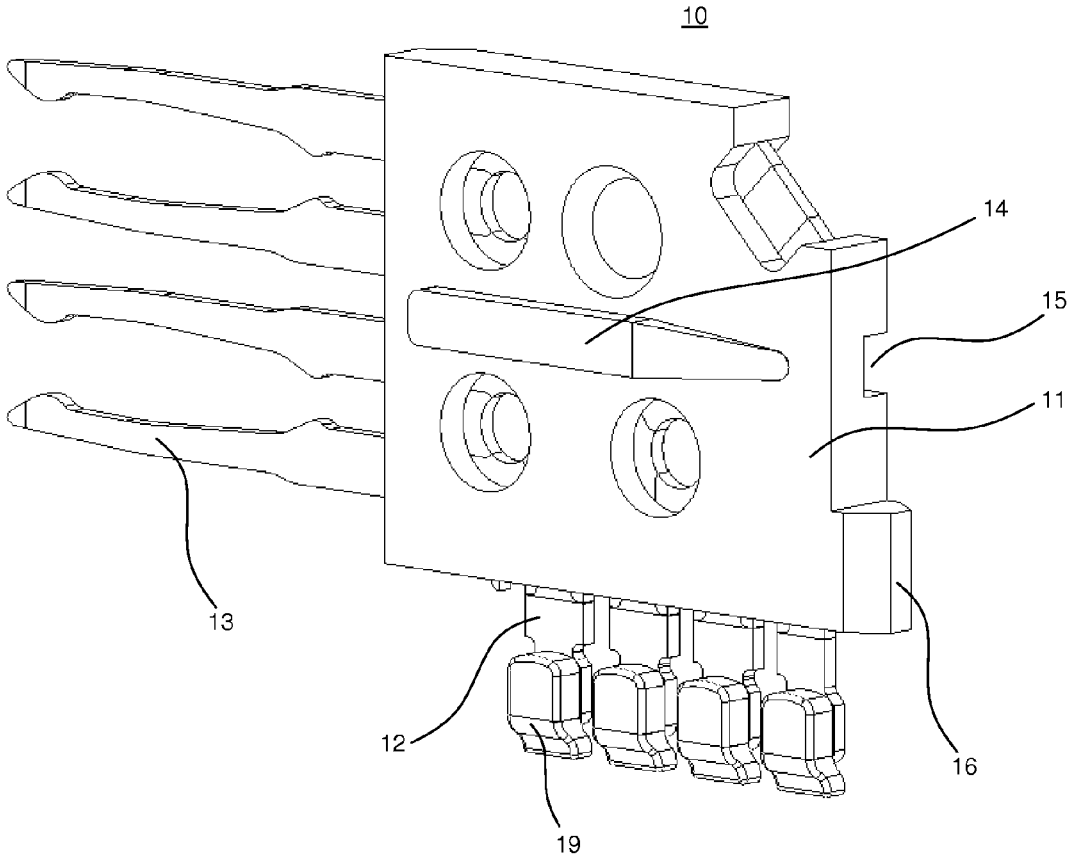
FIGS. 11A and 11B are side perspective views of one of the wafers of the right-angle connector shown in FIGS. 4A and 4B.
Figure 11B:
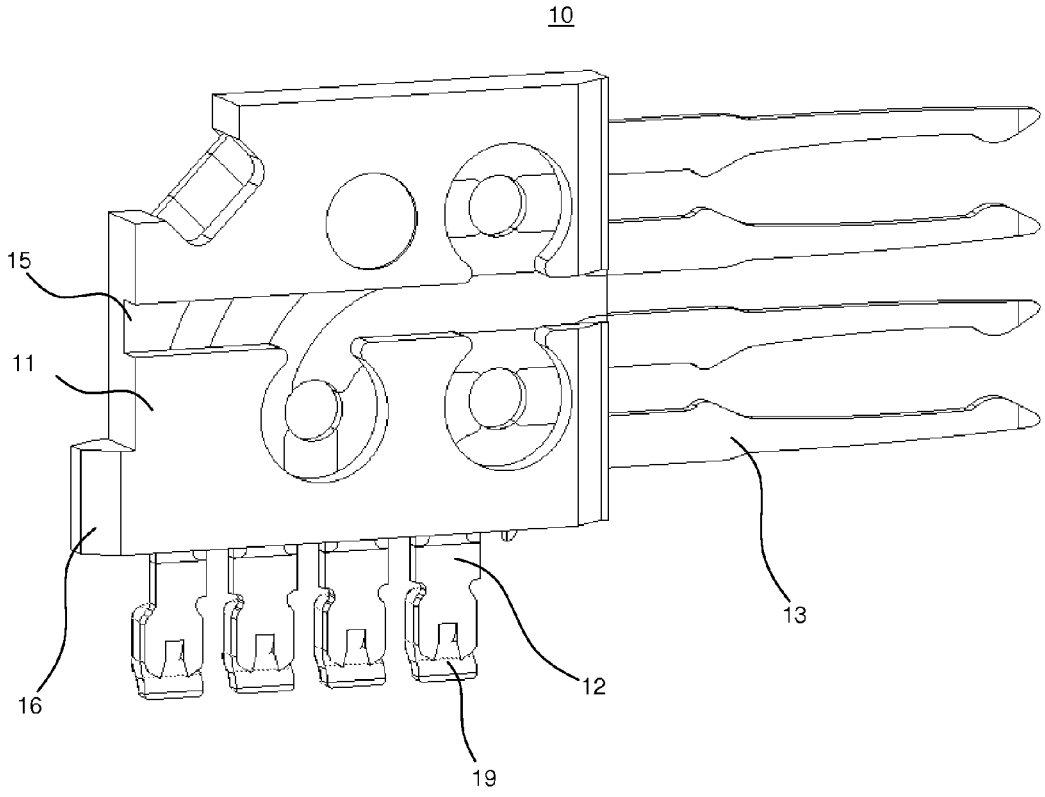

FIGS. 11A and 11B are side perspective views of one of the wafers 10. Each of the wafers 10 includes a wafer body 11 with wafer legs 12 and wafer arms 13 extending therefrom. Each of the wafer legs 12 includes a solder charge 19 and is electrically connected with a corresponding one of the wafer arms 13. Preferably, the wafer legs 12 and wafer arms 13 are provided in corresponding pairs as single, unitary members. The wafer 10 shown in FIGS. 11A and 11B includes the wafer lug 16 that is integrally molded onto alternating ones of the wafers 10. As shown in FIG. 11A, one side of each of the wafers 10 includes a wafer rib 14. As shown in FIG. 11B, the other side of each of the wafers 10 includes a wafer groove 15.

Figure 12:
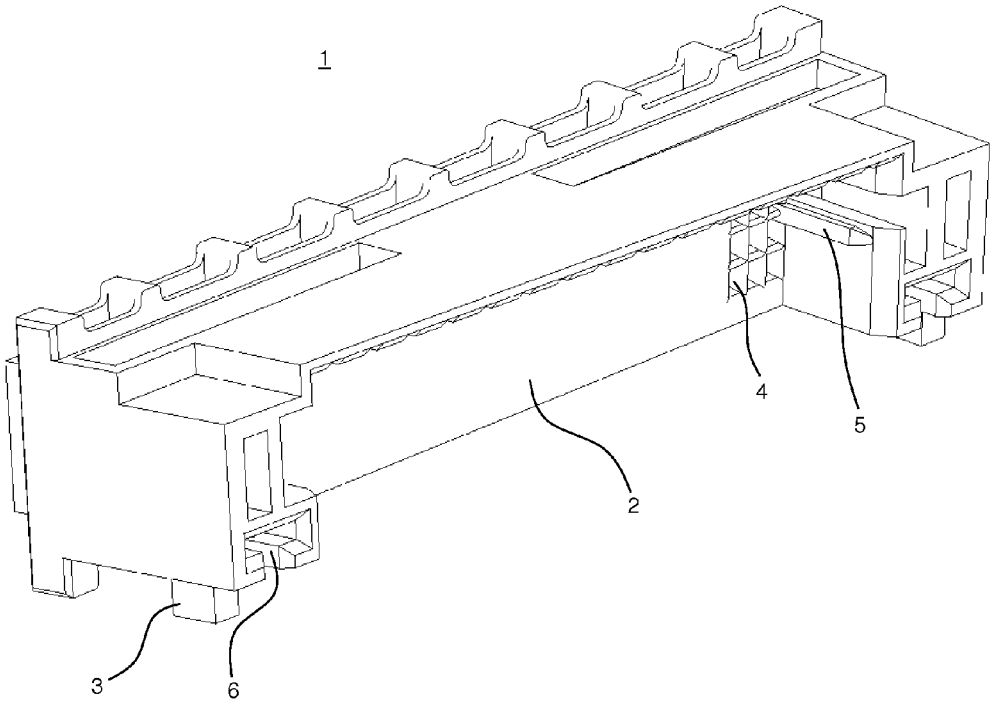
FIG. 12 is a perspective view of the right-angle connector shown in FIGS. 4A and 4B without any wafers included therein.
Figure 13:
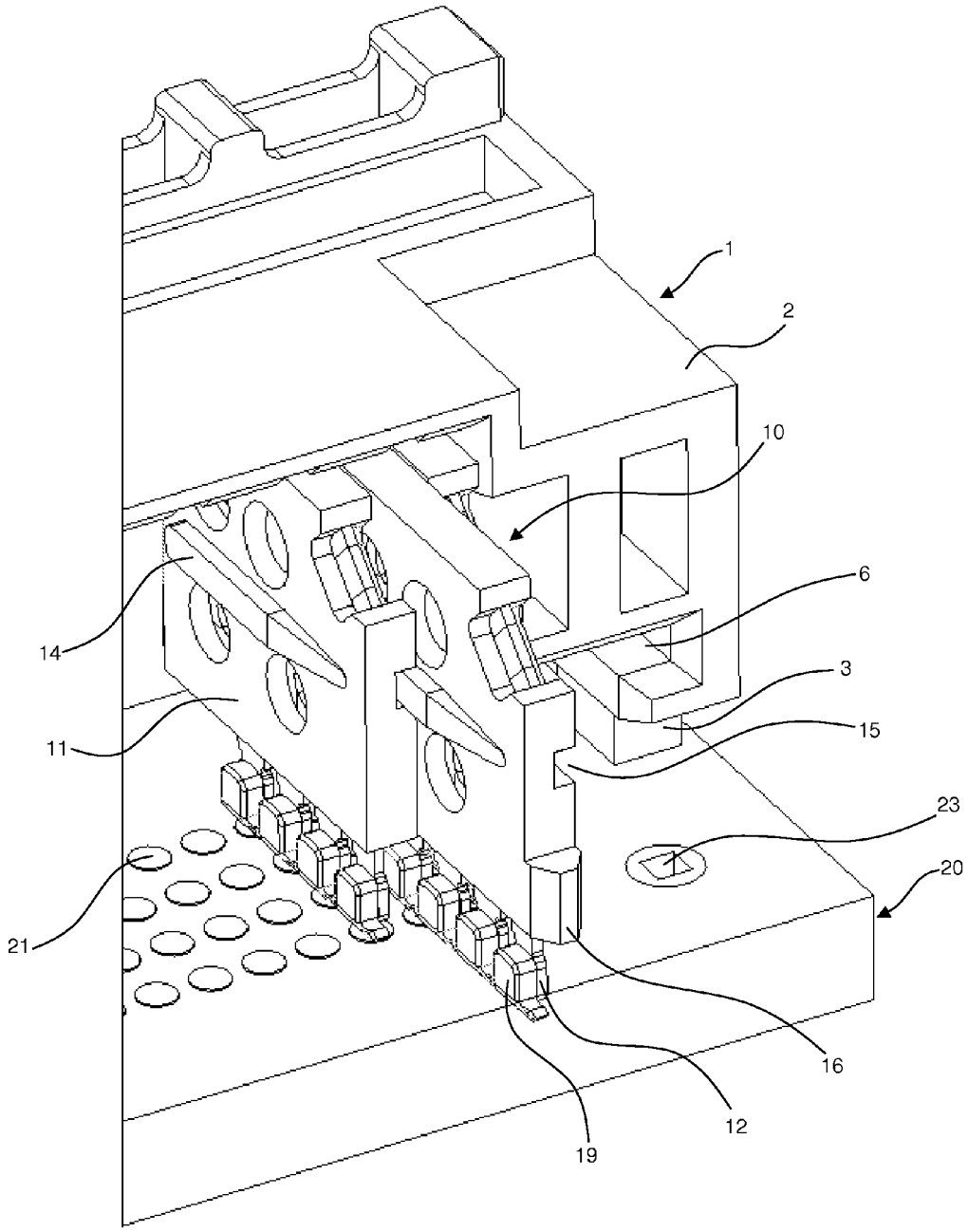
FIG. 13 is a perspective view of a wafer being inserted into the right-angle connector shown in FIGS. 4A and 4B.
Figure 14:
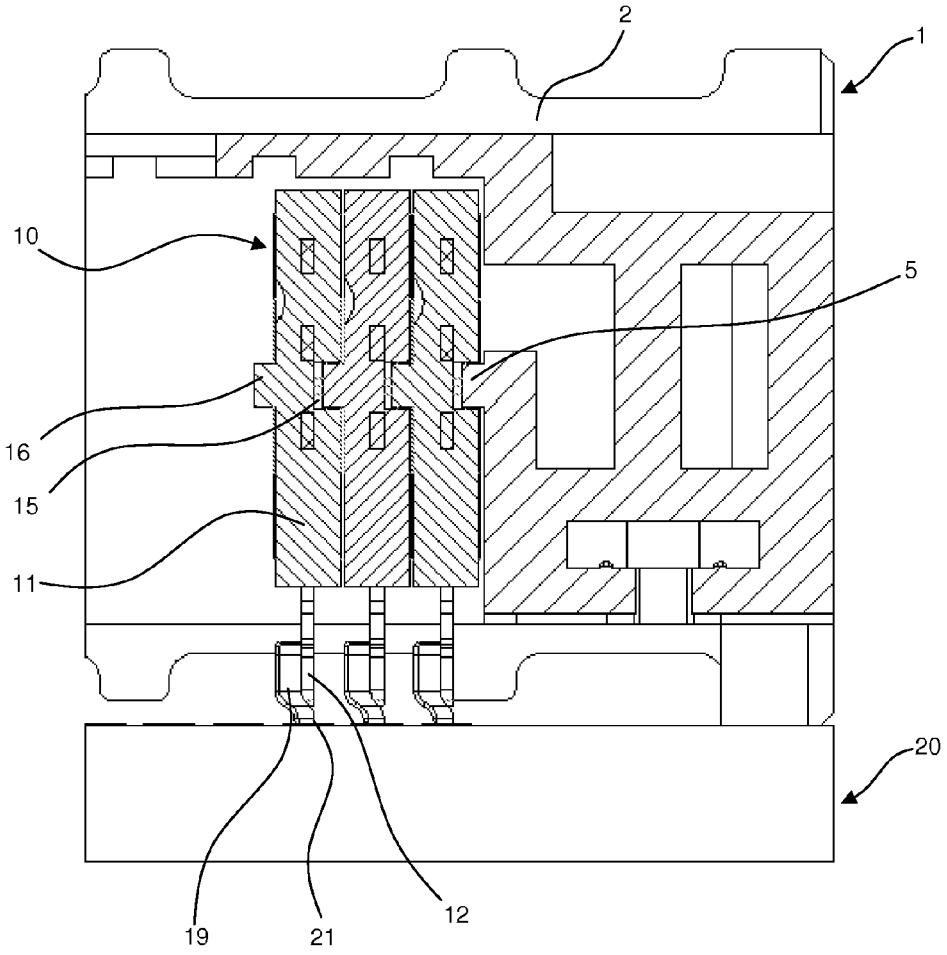
FIG. 14 is a cross-sectional view of the right-angle connector shown in FIGS. 4A and 4B.

FIG. 12 is a perspective view of the right-angle connector 1 without any wafers 10 included therein, and FIG. 13 is a perspective view of a wafer 10 being inserted into the right-angle connector 1. FIG. 14 shows a cross-sectional view of the right-angle connector 1. As shown in FIG. 12, the right-angle connector includes wafer arm holes 4 that receive the wafer arms 13 and a connector rib 5 that engages with the wafer groove 15 of one of the wafers 10. Furthermore, as shown in FIG. 12, the connector body 2 of the right-angle connector 1 is susceptible to twisting along its long axis if the wafers 10 and wafer-holding weld tab 30 are not engaged thereto. As shown in FIGS. 13 and 14, the wafer groove 15 of a first one of the wafers 10 receives the connector rib 5, and the wafer rib 14 of the first one of the wafers 10 is received by the wafer groove 15 of a second one of the wafers 10. Correspondingly, wafer ribs 14 and wafer grooves 15 of adjacent ones of the wafers 10 engage with each other to secure the wafers 10 within the right-angle connector 1 and to ensure proper alignment of the wafer legs 12 with their corresponding pads 21 on the circuit board 20. In particular, the interlocking wafer ribs 14 and wafer grooves 15 provide co-planar or substantially co-planar bottom surfaces of the solder charges 19 attached to the wafer legs 12. Preferably, the bottom surfaces of the solder charges 19 attached to the wafer legs 12 are co-planar within a tolerance of 0.006", for example.

Because the wafer-holding weld tab 30 includes the pattern of weld tab slots 33 as shown in FIG. 4A that engage with wafer lugs 16 on every other wafer 10, it is certain that the wafers 10 are inserted into the right-angle connector 1 in the proper alternating arrangement. If the wafers 10 are not placed in the right-angle connector 1 in the correct order, the weld tab slots 33 of the wafer-holding weld tab 30 will not properly align with the wafer lugs 16, and thus the weld tab arms 32 of the wafer-holding weld tab 30 will not fully seat into the weld tab arm holes 6 of the right-angle connector 1.

Figure 15A:
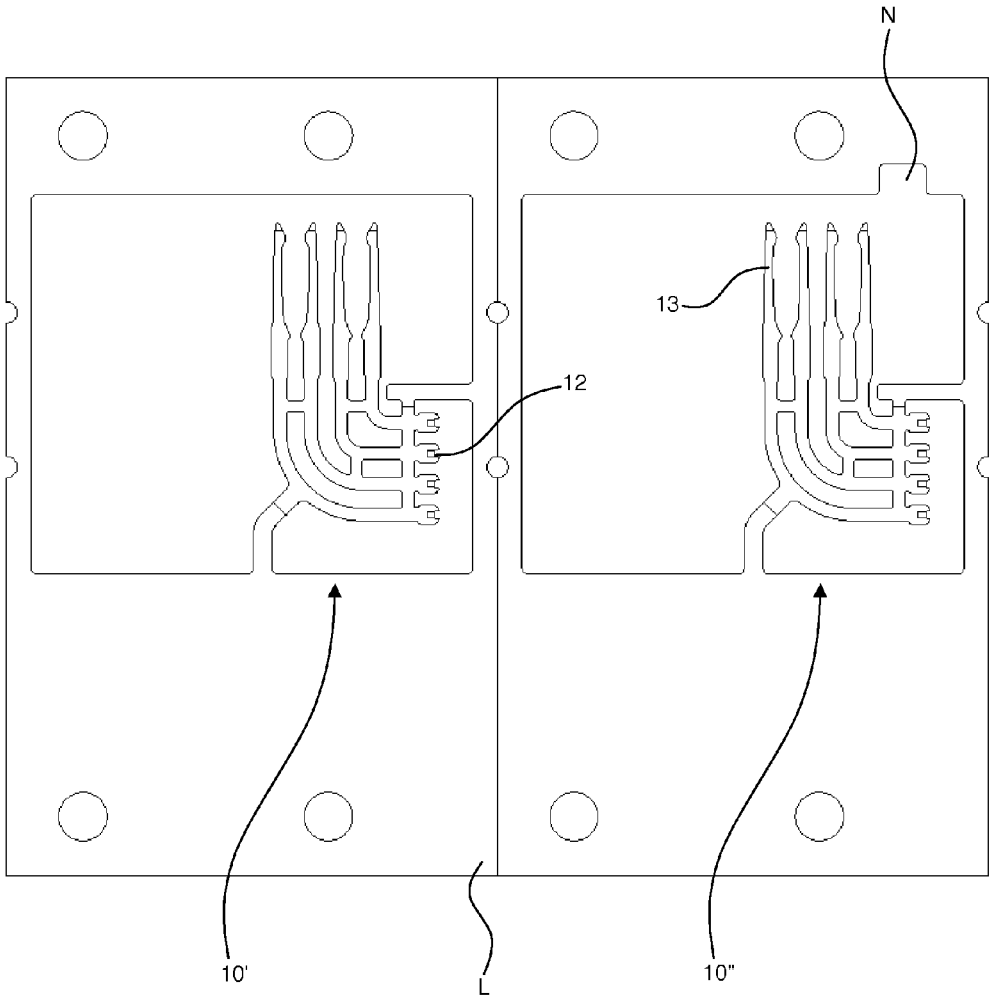
FIGS. 15A and 15B are planar views of manufacturing odd and even wafers according to a preferred embodiment of the present invention.
Figure 15B:
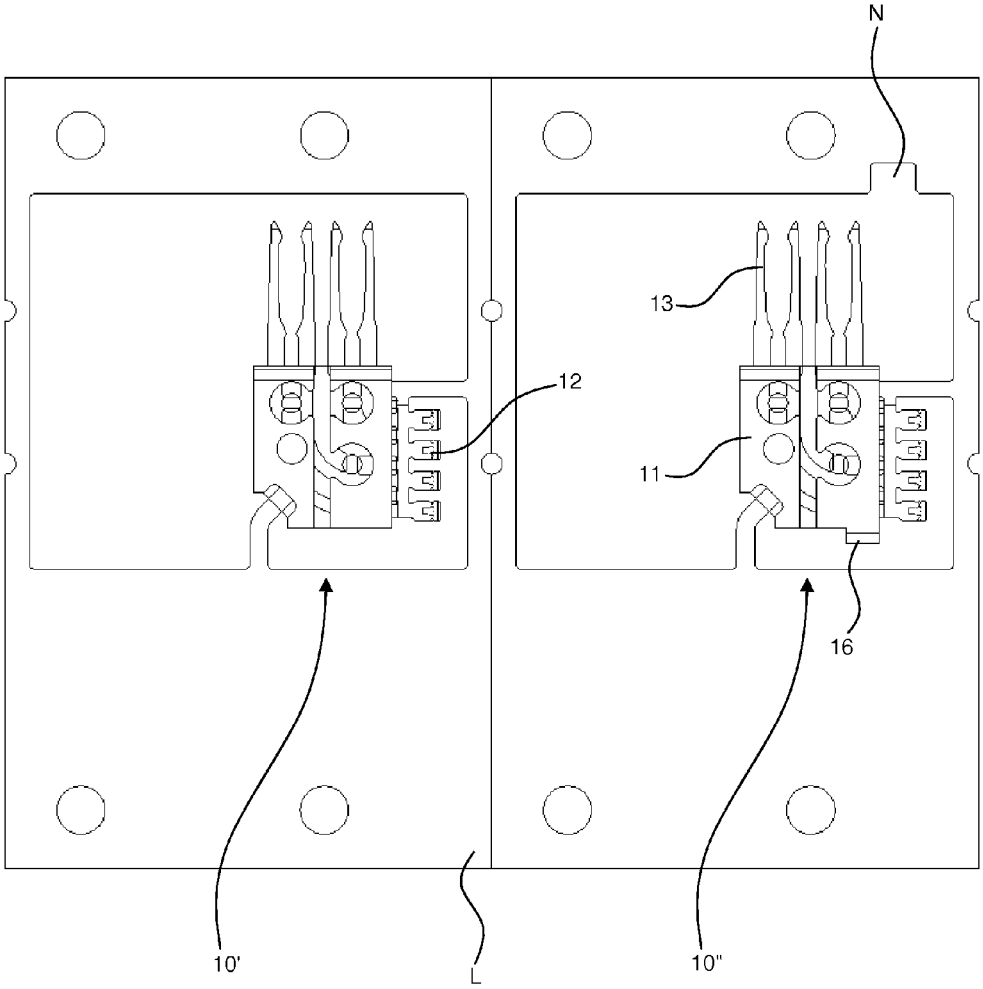

Accordingly, a preferred manufacturing process for the wafers 10 includes an indicator for odd and even ones of the wafers 10 during manufacture. FIGS. 15A and 15B are planar views of manufacturing odd wafers 10' and even wafers 10" according to a preferred embodiment of the present invention. As shown in FIG. 15A, each of the wafers 10' and 10" starts out as a stamped leadframe L that includes the wafer legs 12 and the wafer arms 13 and is preferably stamped from a continuous strip. Even wafers 10" are identified in the stamped leadframe L by locator notches N. The contact areas of the wafer legs 12 and the wafer arms 13 are then plated to ensure good electrical conductivity. As shown in FIG. 15B, the wafer bodies 11 are molded over the wafer legs 12 and the wafer arms 13 and wafer lugs 16 are integrally molded onto the even wafers 10", which are identified during the molding process by the locator notches N. The wafers 10' and 10" are then cut from the stamped leadframe L. The locator notches N allow for easy identification of the odd wafers 10' and the even wafers 10", for example, if the manufacturing process is stopped and then restarted or if the continuous strip requires a splice.

Figure 16A:
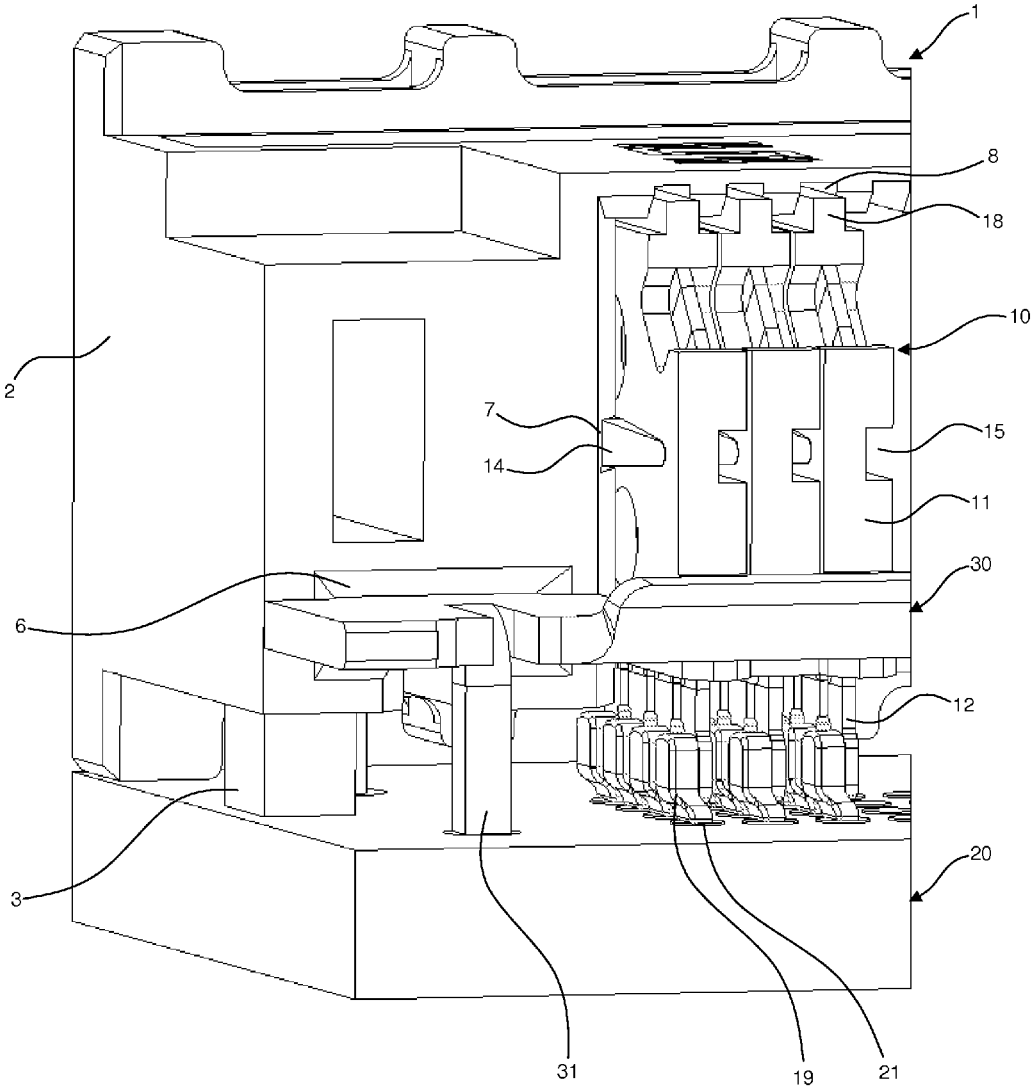
FIGS. 16A and 16B are perspective and front views of vertical slots included in the right-angle connector and vertical ribs included in the wafers according to a preferred embodiment of the present invention.
Figure 16B:
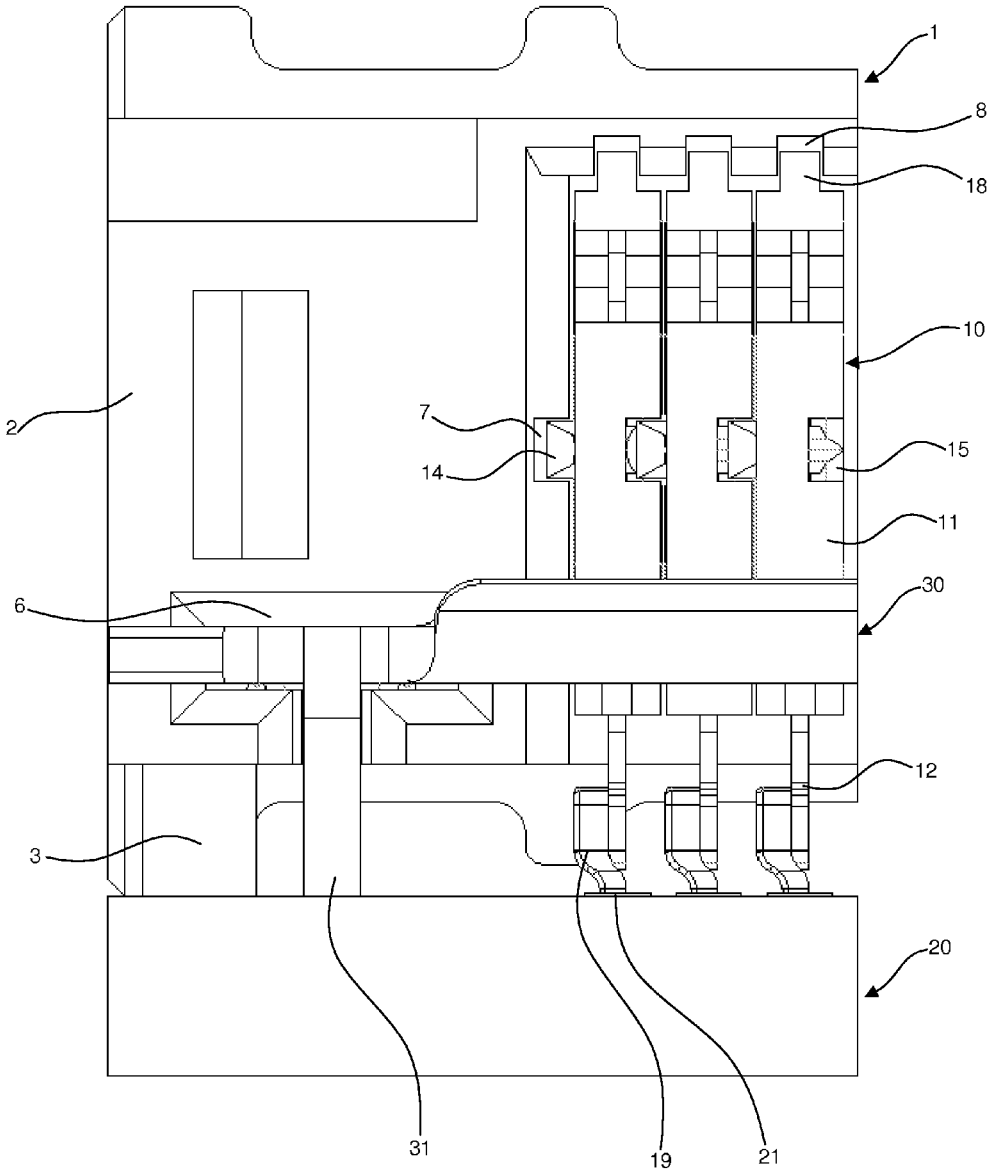

According to a preferred embodiment of the present invention, the wafers 10 preferably include vertical ribs 18 that engage with vertical slots 8 included in the connector body 2 of the right-angle connector 1 as shown in FIGS. 16A and 16B. The alignment of the vertical ribs 18 and the vertical slots 8 further ensures proper alignment of the wafer legs 12 with their corresponding pads 21 on the circuit board 20 and provides additional resistance against twisting of the connector body 2.

Furthermore, as shown in FIGS. 16A and 16B, the connector body 2 of the right-angle connector 1 preferably includes a connector groove 7 that engages with the wafer rib 14 of the last one of the wafers 10 included in the right-angle connector 1 to further secure and support the wafers 10 within the connector body 2.

Figure 17A:
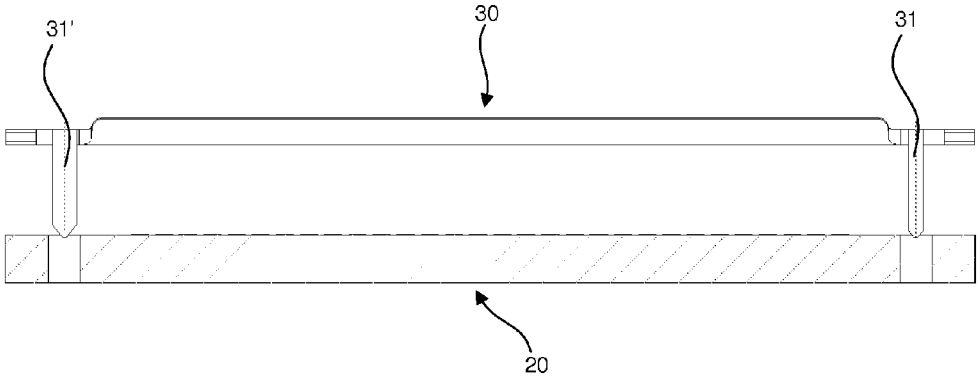
FIG. 17A is a cross-sectional view of a wafer-holding weld tab and circuit board according to a preferred embodiment of the present invention.
Figure 17B:
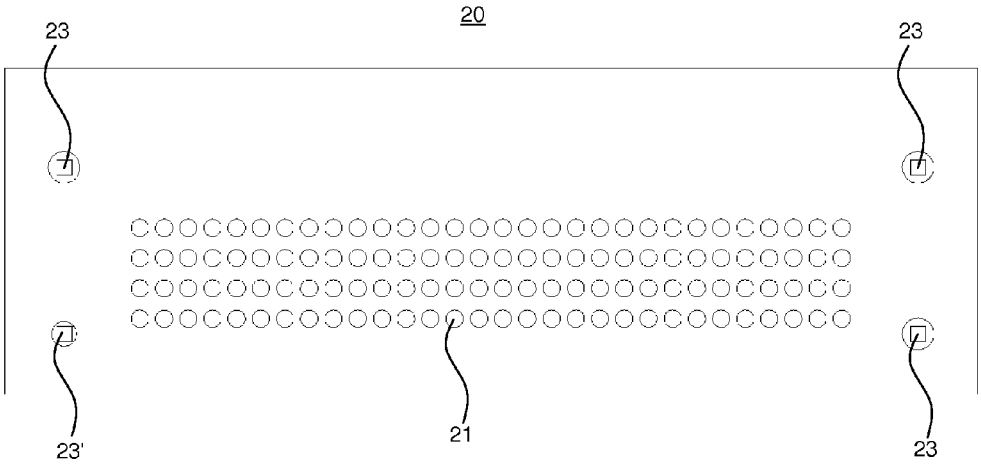
FIG. 17B is a top view of a circuit board according to a preferred embodiment of the present invention.
Figure 17C:
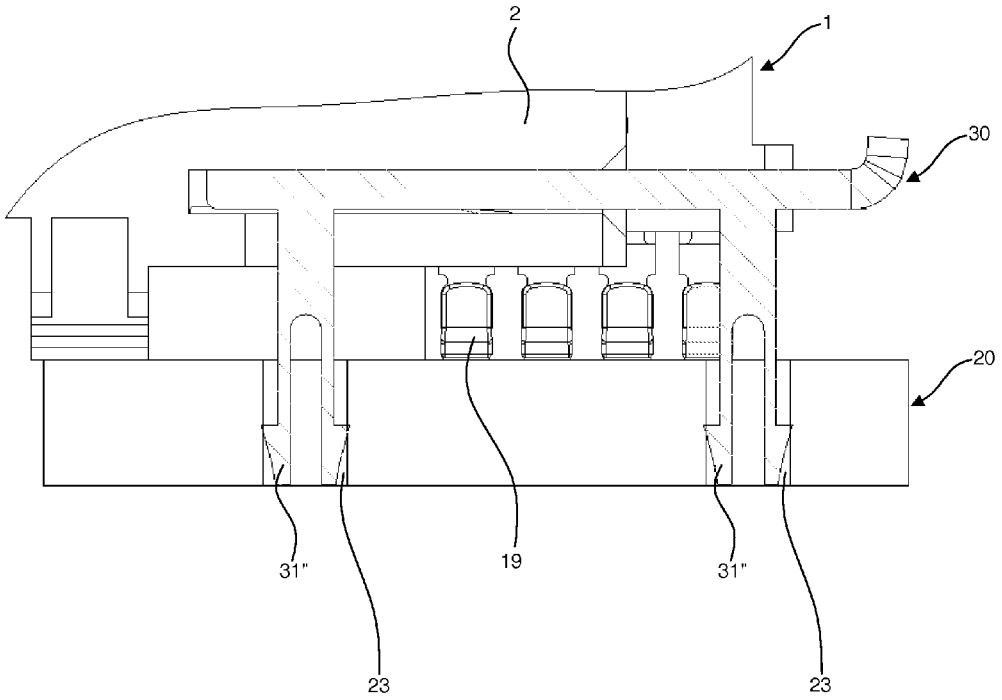
FIGS. 17C and 17D are cross-sectional views of a wafer-holding weld tab and circuit board according to a preferred embodiment of the present invention.
Figure 17D:
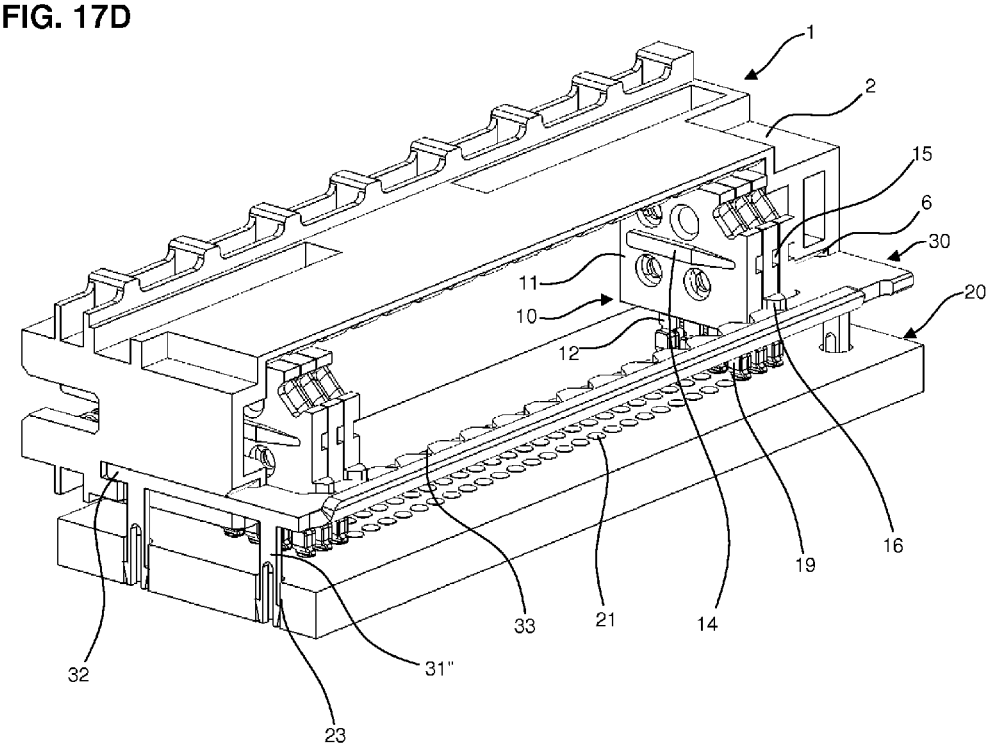

Preferably, as shown in FIG. 17A, one of the weld tab legs 31' is wider than the other weld tab legs 31 in order to provide initial alignment for the right-angle connector 1 when it is mounted to the circuit board 20. That is, the wider one of the weld tab legs 31' provides less clearance when engaged with its corresponding weld hole 23 to accurately align the wafer-holding weld tab 30 and the right-angle connector 1 to the pads 21 of the circuit board 20. Alternatively, instead of forming one of the weld tab legs 31' wider than the other weld tab legs 31, one of the weld holes 23' may be narrower than the other weld holes 23, as shown in FIG. 17B. Furthermore, as shown in FIGS. 17C and 17D, the weld tab legs 31 may be replaced by locking legs 31" that mechanically deform when inserted into the weld holes 23 of the circuit board to secure the right-angle connector 1 to the circuit board 20 by a frictional fit. Additionally, instead of being inserted into holes in the circuit board 20, the weld tab legs 31 may be surface mountable such that weld tab legs 31 are connected, typically by solder, to the surface of the circuit board 20 when the right-angle connector 1 is mounted to the circuit board 20. The weld tab legs 31 can also be arranged as clips to mechanically attach the right-angle connector 1 to the circuit board 20. For example, the weld tab legs 31 can be clipped to a hole or slot in the circuit board 20, similar to the locking legs 31" shown in FIGS. 17C and 17D, such that the weld tab legs 31 engage with the inside of the hole or slot. However, if the weld tab legs 31 are arranged as clips, the clips can be relied on to temporarily secure the right-angle connector 1 to the circuit board 20 as the solder charges 19 are reflowed. Accordingly, clips provide a low-cost structure to align and initially attach the right-angle connector 1 to the circuit board 20 if the solder joints formed between the wafer legs 12 and the pads 21 are not sufficient to secure the right-angle connector 1 to the circuit board 20.

Figure 18A:
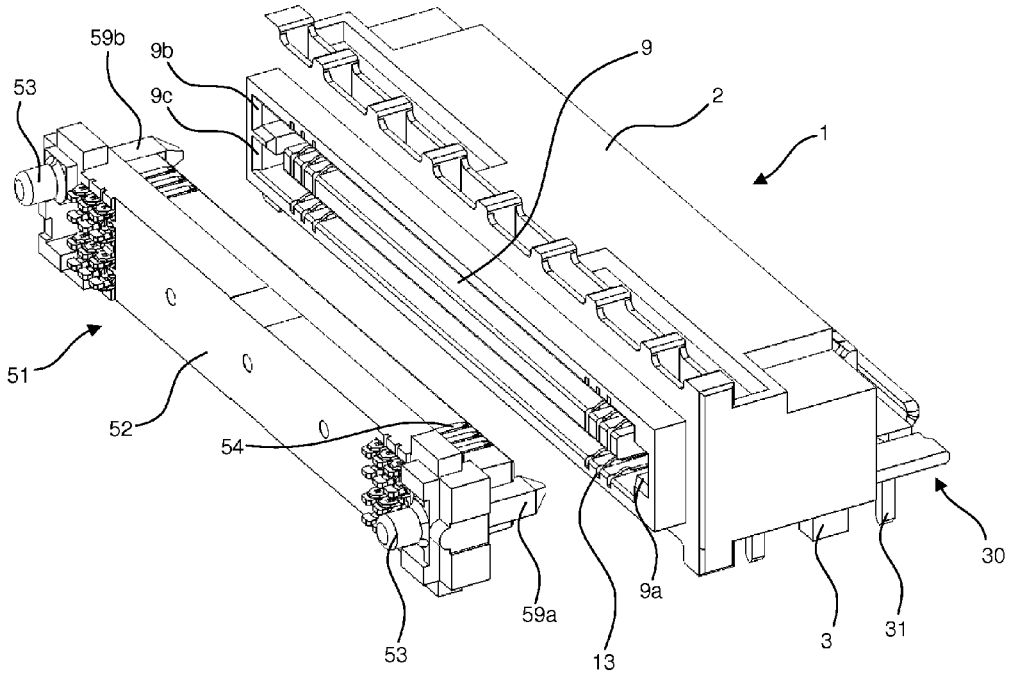
FIGS. 18A and 18B are perspective views of a preferred embodiment of a plug connector arranged to mate with the right-angle connector shown in FIGS. 4A and 4B.
Figure 18B:
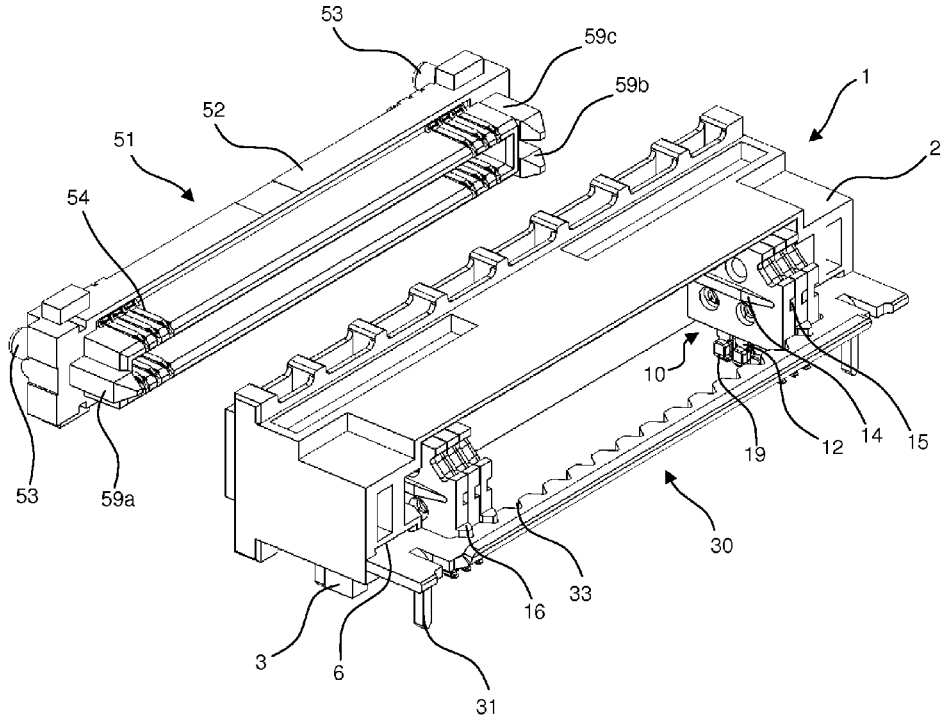

As shown in FIGS. 18A and 18B, a preferred embodiment of a connector that mates with the right-angle connector 1 is a plug connector 51. The plug connector 51 includes contacts 54 that engage with corresponding wafer arms 13 that are exposed in the contact section 9 of the right-angle connector 1. The plug connector 51 also includes polarization stakes 59*a*, 59*b*, and 59*c* that respectively engage with the polarization notes 9*a*, 9*b*, and 9*c* in the contact section 9 of the right-angle connector 1 to ensure that the plug connector 51 and the right-angle connector 1 mate in the proper orientation. The plug connector 51 is preferably arranged on a corresponding circuit board or electrical device by alignment pins 53 that are molded into the body 52 of the plug connector 51.

According to the preferred embodiments of the present invention, the wafer-holding weld tab 30 is used to align and secure the right-angle connector 1 to the circuit board 20. As compared with using separate, individual weld tabs, the wafer-holding weld tab 30 provides greater accuracy when aligning the right-angle connector 1 to the circuit board 20, provides simpler mounting due to a single step to engage each of the weld holes 23 of the circuit board 20, and prevents accidental movement or withdrawal of the wafers 10 and twisting of the connector body 2.

Although FIGS. 4A-18B show the preferred embodiments of the present invention implemented using a right-angle connector because wafers are most commonly found in right-angle connectors, it is possible to use any type of connector that uses wafers, including, for example, a vertical connector (e.g., an interposer or a height extender).

Figure 21:
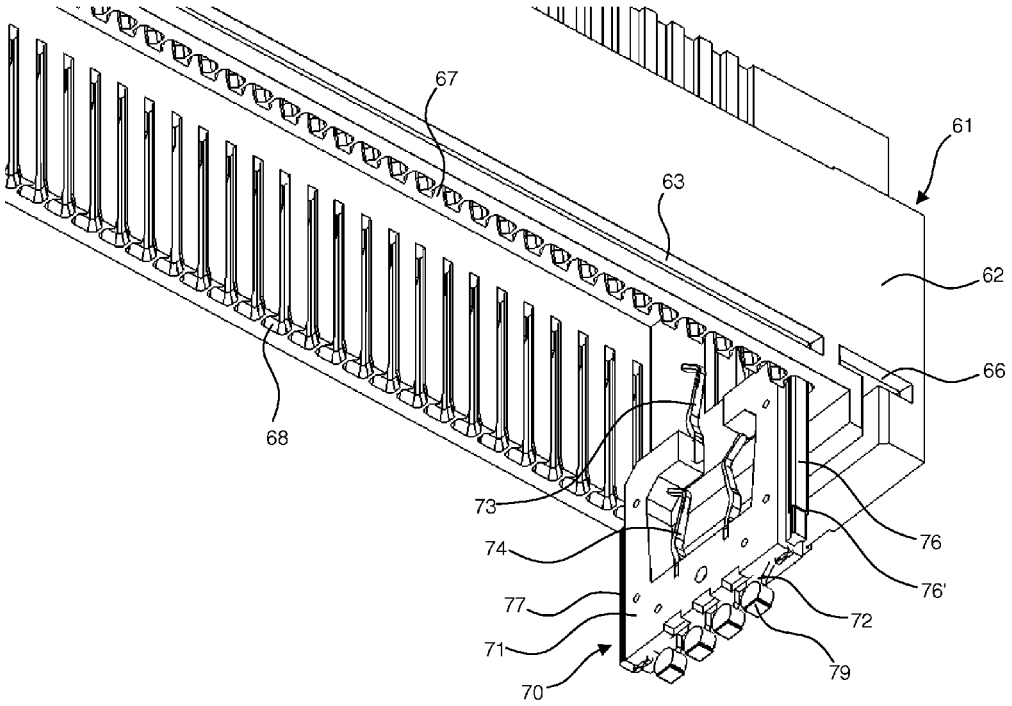
FIG. 21 is a bottom perspective view of the vertical wafer shown in FIG. 20 being inserted into the vertical connector shown in FIG. 19.
Figure 22:
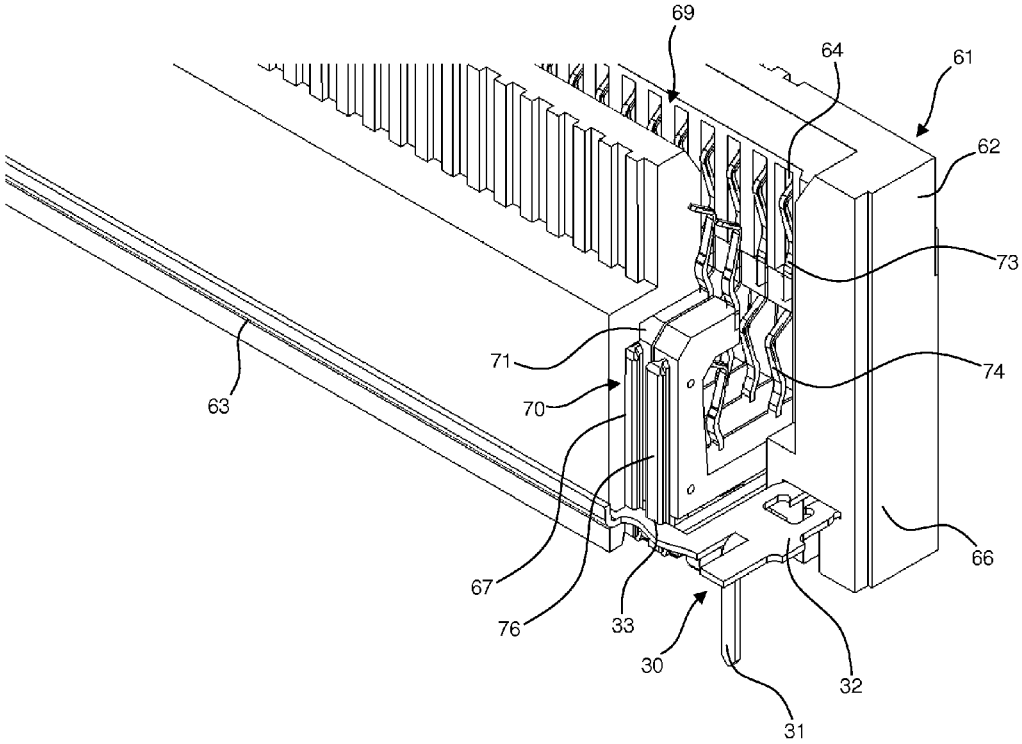
FIG. 22 is a perspective cut-away view of the vertical connector shown in FIG. 19
Figure 23:
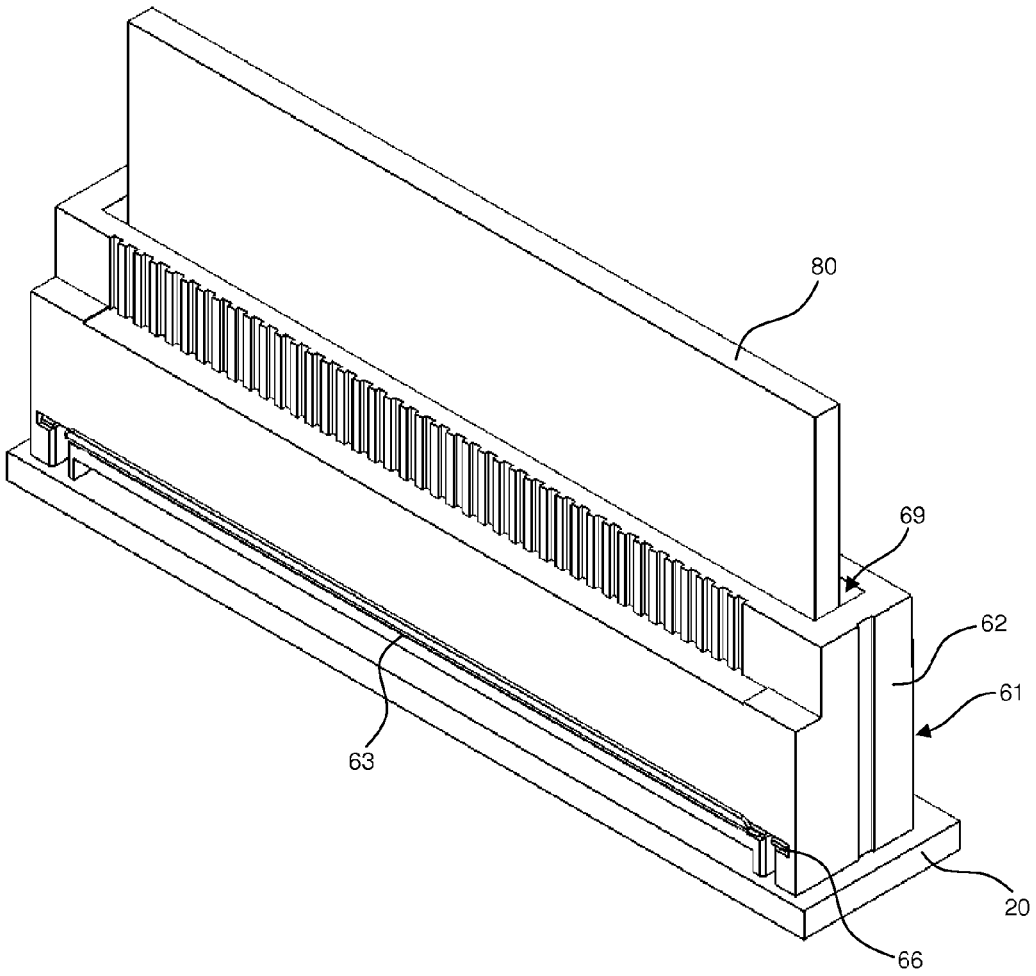
FIG. 23 is perspective view of the vertical connector shown in FIG. 19 connected to a circuit board and mated with an edge card.
Figure 24:
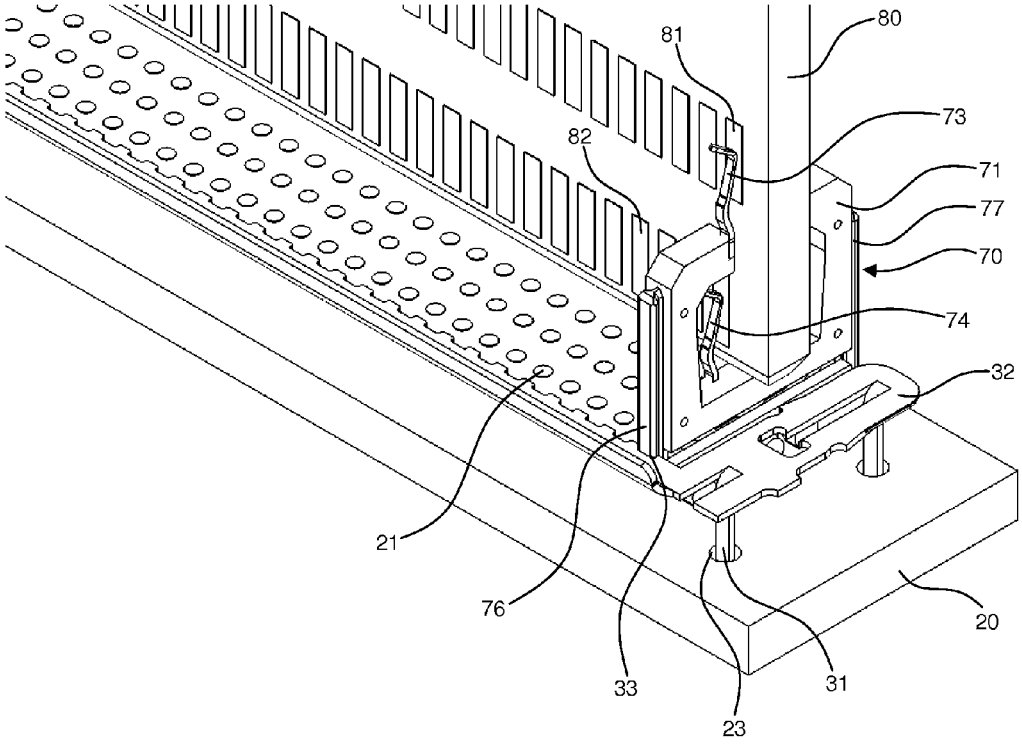
FIG. 24 is a perspective view of the vertical connector, the wafer-holding weld tab, the circuit board, and the edge card of FIGS. 19-23 with the connector body removed for clarity.

FIGS. 19-25 show a vertical connector 61 in accordance with a preferred embodiment of the present invention. As shown in FIGS. 19, 22, 24, and 25, the vertical connector 61 is preferably arranged to receive the same or similar wafer-holding weld tab 30 as the right-angle connector 1 described above. Further, as shown in FIGS. 23 and 24, the vertical connector 61 is preferably arranged to be mounted on circuit board 20.

As shown in FIGS. 20-22, 24, and 25, the vertical connector 61 includes vertical wafers 70 with wafer legs 72 that are electrically connected to the pads 21 of the circuit board 20. The weld tab arms 32 of the wafer-holding weld tab 30 engage with weld tab arm holes 66 of the vertical connector 61. The weld tab legs 31 engage with the weld holes 23 of the circuit board 20 to secure the vertical connector 61 to the circuit board 20 and to reduce stresses applied to solder joints between the wafer legs 72 and the pads 21 of the circuit board 20. These solder joints are preferably provided by solder charges 79 that are attached to the wafer legs 72 and then reflowed after the vertical connector 61 is mounted to the circuit board 20 to provide electrical connections between the wafer legs 72 and the pads 21. Instead of solder charges 79, any fusible member that can mechanically secure the wafer legs 12 to the circuit board 20 while providing an electrical connection, including, for example, crimped solder, solder balls, etc., can be used.

As shown in FIGS. 19, 20, 22, 24, and 25 the weld tab slots 33 of the wafer-holding weld tab 30 preferably engage with first wafer lugs 76 that are integrally molded on each of the vertical wafers 70. Preferably, the first wafer lugs 76 each include a narrowed lower portion such that a first wafer lug shoulder 76' is provided in each of the first wafer lugs 76. The weld tab slots 33 preferably engage with the first wafer lugs 76 at the first wafer lug shoulders 76'. Accordingly, when the weld tab arms 32 of the wafer-holding weld tab 30 are fully inserted into the weld tab arm holes 66 of the vertical connector 61, the first wafer lug shoulders 76' interlock with the weld tab slots 33 to provide vertical support for the wafers 70 and to ensure that the wafer legs 72 of the vertical wafers 70 align with the correct corresponding pads 21 of the circuit board 20.

As shown in FIGS. 19 and 21-25, the vertical connector 61 preferably includes a weld tab groove 63 that allows the weld tab slots 33 of the weld tab 30 to pass through the body 62 of the vertical connector 61. Although the body 62 of the vertical connector 61 can be molded so that weld tab groove 63 is separate from the weld tab arm holes 66, a single, continuous groove with the weld tab arm holes 66 can also be provided. Furthermore, the wafer-holding weld tab 30 provides a rigid structure that resists any shifting of the vertical wafers 70 or twisting of the connector body 62 along its longitudinal or lengthwise axis, for example, when the vertical connector 61 is exposed to high temperatures during soldering of the wafer legs 72 to the pads 21 of the circuit board 20. Preferably, the weld tab 30 is flush or substantially flush with the outer surface of the connector body 62 when the weld tab arms 32 and the weld tab slots 33 are fully inserted, respectively, into the weld tab arm holes 66 and the weld tab groove 63 of the vertical connector 61.

Figure 19:
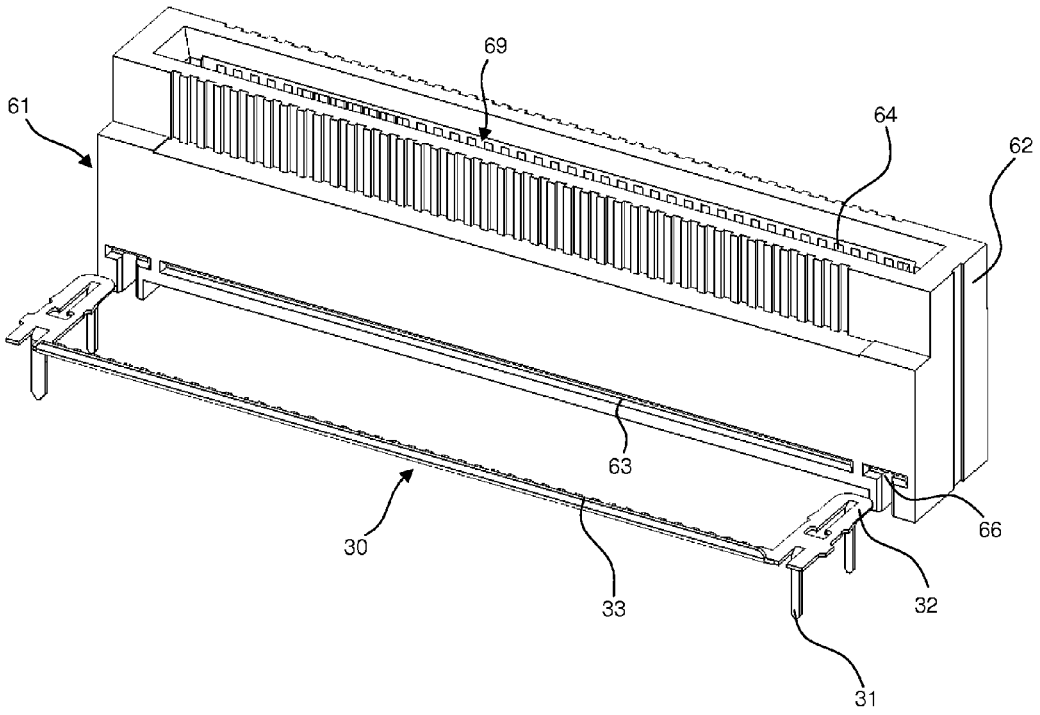
FIG. 19 is a perspective view of a vertical connector according to a preferred embodiment of the present invention and the wafer-holding weld tab shown in FIGS. 8A and 8B.
Figure 25:
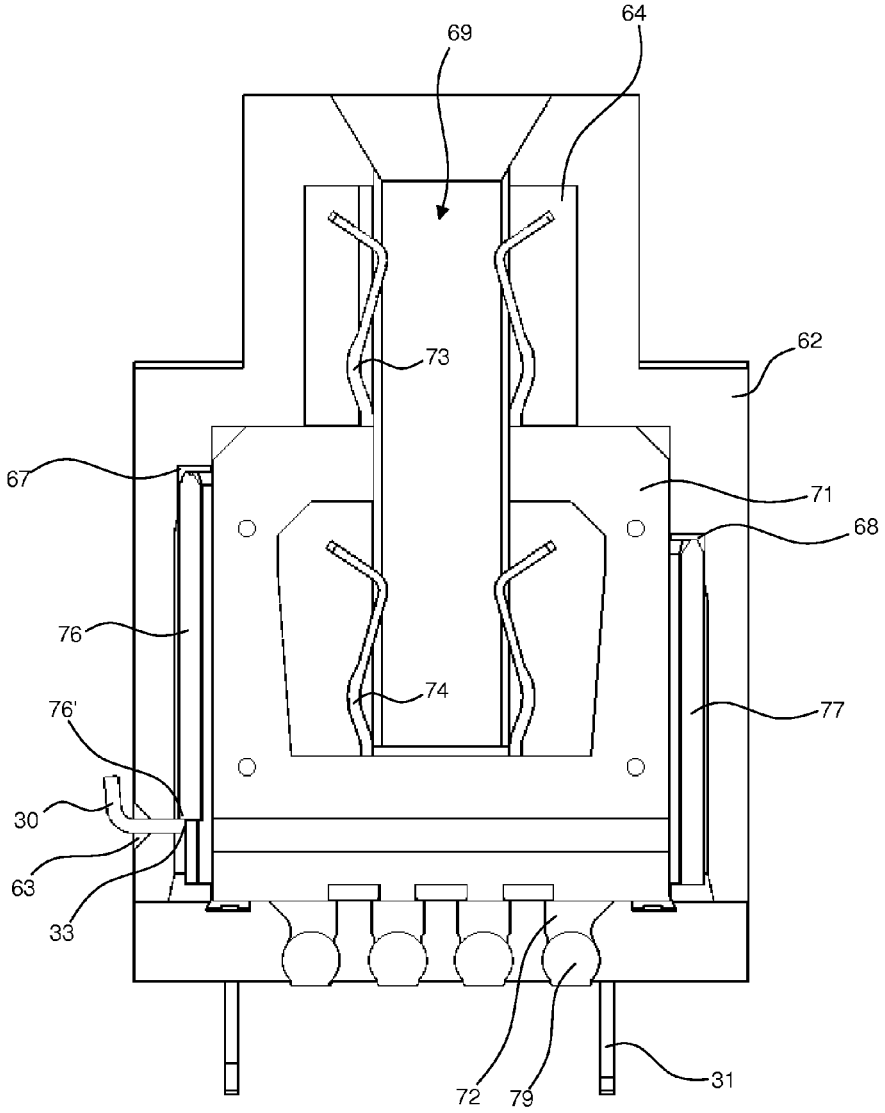
FIG. 25 is a cross-sectional view of the vertical connector shown in FIG. 19.

As shown in FIGS. 19, 22, 23, and 25, the upper surface of the vertical connector 61 includes a contact section 69 for mating with another electrical element. Preferably, the contact section 69 of the vertical connector 61 is arranged to engage with an edge card 80, as shown in FIGS. 23 and 24. The vertical wafers 70 preferably each include a pair of first wafer arms 73 and a pair of second wafer arms 74, as shown in FIGS. 20-23, 24, and 25, that are exposed at the contact section 69 of the vertical connector 61. As shown in FIGS. 19, 22, and 25, each of the first pairs of wafer arms 73 is preferably arranged in a corresponding wafer arm recess 64 of the vertical connector 61. Accordingly, when the edge card 80 is fully inserted into the contact section 69 of the vertical connector 61, the pair of first wafer arms 73 and the pair of second wafer arms 74 preferably engage with respective rows of first pads 81 and rows of second pads 82 that are arranged on opposing planar surfaces of the edge card 80, as shown in FIG. 24. The vertical connector 61 is preferably arranged so that the edge card 80 is inserted into the contact section 69 in a direction that is perpendicular or approximately perpendicular to the top planar surface of the circuit board 20.

Figure 20:
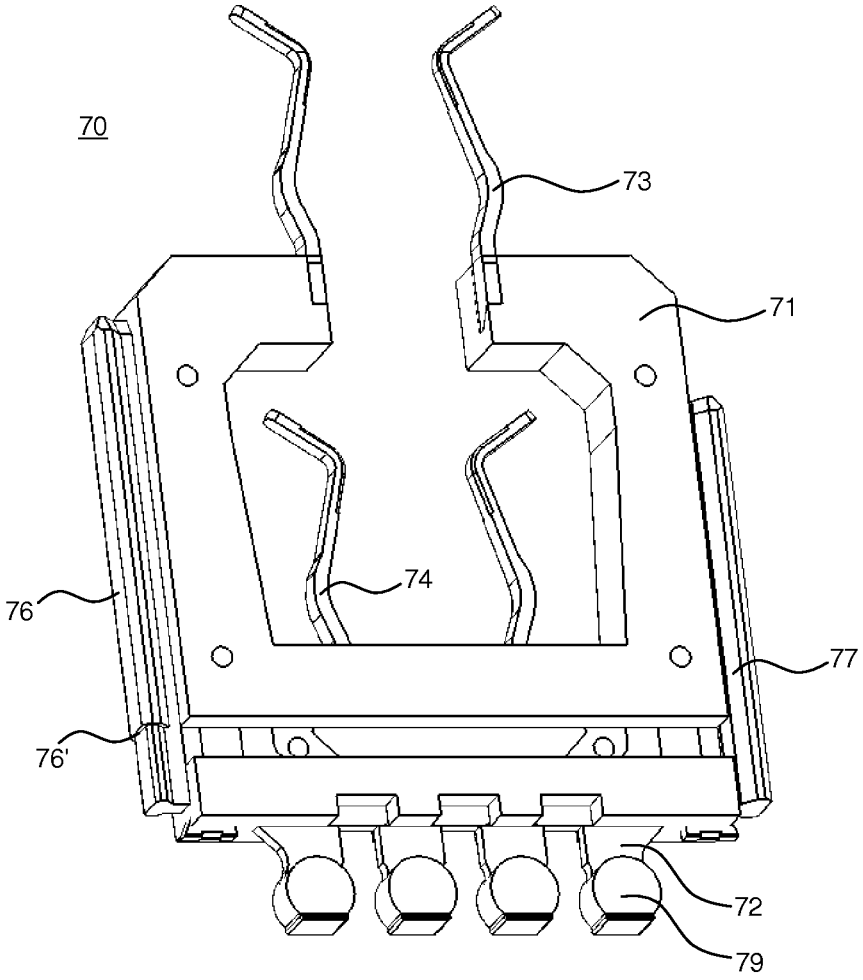
FIG. 20 is a perspective view of a vertical wafer included in the vertical connector shown in FIG. 19.

FIG. 20 is a perspective view of one of the vertical wafers 70. Each of the vertical wafers 70 includes a wafer body 71 with wafer legs 72, the first pair of wafer arms 73, and the second pair of wafer arms 74 extending therefrom. Each of the wafer legs 72 includes a solder charge 79 and is electrically connected with a corresponding one of the wafer arms 73, 74. Preferably, the wafer legs 72 and wafer arms 73, 74 are provided in corresponding pairs as single, unitary members. The solder charges 79 of the vertical wafers 70 for the vertical connector 61 are preferably deposited and/or formed in shapes similar to or the same as the solder charges 19 of the wafers 10 for the right-angle connector 1. The vertical wafer 70 shown in FIG. 20 includes the first wafer lug 76 and a second wafer lug 77 that are integrally molded onto each of the wafers 70.

As shown in FIG. 20, the first wafer lug 76 is preferably longer than the second wafer lug 77. As shown in FIG. 21, the first wafer lug 76 is preferably arranged to engage with a first connector groove 67 of the vertical connector 61, and the second wafer lug is arranged to engage with a second connector groove 68 of the vertical connector 61. Preferably, the first connector groove 67 has a length that is the same or substantially the same as that of the first wafer lug 76, and the second connector groove 68 has a length that is the same or substantially the same as that of the second wafer lug 77. Accordingly, if the vertical wafer 70 is inserted into the vertical connector 61 in an improper orientation, such that the first wafer lug 76 is engaged with one of the second connector grooves 68, a bottom portion of the connector body 71 will protrude from the vertical connector 61. Thus, the vertical wafer 70 is only able to be fully inserted into the vertical connector 61 if the wafer lugs 76, 77 are properly aligned with their corresponding connector grooves 67, 68, thereby ensuring that proper electrical connections are made between the correct wafer arms 73, 74 and the pads 21 of the circuit board 20. The engagement of the wafer lug shoulders 76' with the weld tab slots 33 provides co-planar or substantially co-planar bottom surfaces of the solder charges 79 attached to the wafer legs 72, due to the wafer lug shoulders 76' being vertically supported and positioned by the weld tab slots 33, as shown in FIG. 25. Preferably, the bottom surfaces of the solder charges 79 attached to the wafer legs 72 are co-planar within a tolerance of 0.006", for example.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A connector comprising:

a connector body;

a plurality of wafers arranged within the connector body; and a weld tab defined by a unitary member that includes a plurality of weld tab legs and a plurality of weld tab arms; wherein the plurality of weld tab arms are arranged to engage with corresponding weld tab arm holes included in the connector body;

the plurality of weld tab legs are arranged to engage with a circuit board when the connector is mounted to the circuit board;

the weld tab prevents the plurality of wafers from withdrawing from the connector body when the plurality of weld tab arms are engaged with the corresponding weld tab arm holes;

each of the plurality of wafers includes at least one wafer leg arranged to engage with a corresponding pad on the circuit board when the connector is mounted to the circuit board;

each of the plurality of wafers includes at least one wafer arm arranged to engage with a corresponding wafer arm hole included in the connector body; and the at least one wafer arm passes through the connector body and is exposed at a contact section of the connector.

2. The connector according to claim 1, wherein:

a first group of the plurality of wafers each includes a wafer lug;

the weld tab includes a plurality of weld tab slots arranged to receive the wafer lugs;

the first group of the plurality of wafers that each includes the wafer lug are arranged in an alternating manner in the connector body with respect to a second group of the plurality of wafers that do not each include the wafer lug; and the plurality of weld tab slots are arranged to engage with the wafer lugs when the plurality of weld tab arms are engaged with the corresponding weld tab arm holes.

3. The connector according to claim 1, wherein:

the at least one wafer leg of each of the plurality of wafers includes a fusible member arranged at a lower portion thereof; and the fusible member of the at least one wafer leg is arranged so that a contact area between the fusible member and the corresponding pad on the circuit board overlaps with a centerline of the at least one wafer leg.

4. The connector according to claim 3, wherein the corresponding pad on the circuit board is circular or substantially circular.

5. The connector according to claim 1, wherein each of the at least one wafer leg and each of the at least one wafer arm are provided in a corresponding pair defined by a single, unitary member.

6. The connector according to claim 1, wherein:

one planar surface of each of the plurality of wafers includes a wafer rib; and another planar surface of each of the plurality of wafers includes a wafer groove.

7. The connector according to claim 6, wherein the wafer rib of at least one of the plurality of wafers is received by the wafer groove of at least another one of the plurality of wafers.

8. The connector according to claim 6, wherein the connector body includes a connector rib; and the wafer groove of one of the plurality of wafers receives the connector rib.

9. The connector according to claim 6, wherein the connector body includes a connector groove; and the connector groove receives the wafer rib of one of the plurality of wafers.

10. The connector according to claim 1, wherein at least one of the plurality of wafers includes a vertical rib that engages with a corresponding vertical slot included in the connector body.

11. The connector according to claim 1, wherein one of the plurality of weld tab legs has a width greater than remaining ones of the plurality of weld tab legs to align the connector with respect to the circuit board.

12. The connector according to claim 1, wherein the plurality of weld tab legs are arranged to engage with corresponding weld holes in the circuit board when the connector is mounted to the circuit board.

13. The connector according to claim 12, wherein one of the weld holes in the circuit board is narrower than remaining ones of the weld holes to align the connector with respect to the circuit board.

14. The connector according to claim 12, wherein the plurality of weld tab legs is arranged to mechanically deform when inserted into the corresponding weld hole of the circuit board to frictionally fit and align the connector to the circuit board.

15. The connector according to claim 12, wherein the plurality of weld tab legs are arranged to be inserted into the corresponding weld holes and soldered to the corresponding weld holes when the connector is mounted to the circuit board.

16. The connector according to claim 1, wherein the plurality of weld tab legs are arranged to be surface mounted to the circuit board when the connector is mounted to the circuit board.

17. The connector according to claim 1, wherein the plurality of weld tab legs are arranged as a clip to mechanically secure the connector to the circuit board when the connector is mounted to the circuit board.

18. A connector comprising:

a connector body;

a plurality of wafers arranged within the connector body; and a weld tab defined by a unitary member that includes a plurality of weld tab legs and a plurality of weld tab arms; wherein the plurality of weld tab arms are arranged to engage with corresponding weld tab arm holes included in the connector body;

the plurality of weld tab legs are arranged to engage with a circuit board when the connector is mounted to the circuit board;

the weld tab prevents the plurality of wafers from withdrawing from the connector body when the plurality of weld tab arms are engaged with the corresponding weld tab arm holes;

one planar surface of each of the plurality of wafers includes a wafer rib;

another planar surface of each of the plurality of wafers includes a wafer groove;

the connector body includes a connector rib; and the wafer groove of one of the plurality of wafers receives the connector rib.

19. The connector according to claim 8, wherein:

a first group of the plurality of wafers each includes a wafer lug;

the weld tab includes a plurality of weld tab slots arranged to receive the wafer lugs;

the first group of the plurality of wafers that each includes the wafer lug are arranged in an alternating manner in the connector body with respect to a second group of the plurality of wafers that do not each include the wafer lug; and the plurality of weld tab slots are arranged to engage with the wafer lugs when the plurality of weld tab arms are engaged with the corresponding weld tab arm holes.

20. The connector according to claim 18, wherein:

each of the plurality of wafers includes at least one wafer leg arranged to engage the circuit board when the connector is mounted to the circuit board.

21. The connector according to claim 20, wherein:

the at least one wafer leg of each of the plurality of wafers includes a fusible member arranged at a lower portion thereof; and the fusible member of the at least one wafer leg is arranged so that a contact area between the fusible member and the corresponding pad on the circuit board overlaps with a centerline of the at least one wafer leg.

22. The connector according to claim 21, wherein the corresponding pad on the circuit board is circular or substantially circular.

23. The connector according to claim 18, wherein:

each of the plurality of wafers includes at least one wafer leg arranged to engage with a corresponding pad on the circuit board when the connector is mounted to the circuit board; and each of the plurality of wafers includes at least one wafer arm arranged to engage with a corresponding wafer arm hole included in the connector body.

24. The connector according to claim 23, wherein each of the at least one wafer leg and each of the at least one wafer arm are provided in a corresponding pair defined by a single, unitary member.

25. The connector according to claim 21, wherein the at least one wafer arm passes through the connector body and is exposed at a contact section of the connector.

26. The connector according to claim 18, wherein the wafer rib of at least one of the plurality of wafers is received by the wafer groove of at least another one of the plurality of wafers.

27. The connector according to claim 18, wherein the connector body includes a connector groove; and the connector groove receives the wafer rib of one of the plurality of wafers.

28. The connector according to claim 18, wherein at least one of the plurality of wafers includes a vertical rib that engages with a corresponding vertical slot included in the connector body.

29. The connector according to claim 18, wherein one of the plurality of weld tab legs has a width greater than remaining ones of the plurality of weld tab legs to align the connector with respect to the circuit board.

30. The connector according to claim 18, wherein the plurality of weld tab legs are arranged to engage with corresponding weld holes in the circuit board when the connector is mounted to the circuit board.

31. The connector according to claim 30, wherein one of the weld holes in the circuit board is narrower than remaining ones of the weld holes to align the connector with respect to the circuit board.

32. The connector according to claim 30, wherein the plurality of weld tab legs is arranged to mechanically deform when inserted into the corresponding weld hole of the circuit board to frictionally fit and align the connector to the circuit board.

33. The connector according to claim 30, wherein the plurality of weld tab legs are arranged to be inserted into the corresponding weld holes and soldered to the corresponding weld holes when the connector is mounted to the circuit board.

34. The connector according to claim 18, wherein the plurality of weld tab legs are arranged to be surface mounted to the circuit board when the connector is mounted to the circuit board.

35. The connector according to claim 18, wherein the plurality of weld tab legs are arranged as a clip to mechanically secure the connector to the circuit board when the connector is mounted to the circuit board.

* * * * *